US005678149A

United States Patent [19]

Takekoshi et al.

[11] Patent Number: 5,678,149

[45] Date of Patent: Oct. 14, 1997

[54] IMAGE FORMING APPARATUS

[75] Inventors: Nobuhiko Takekoshi; Rie Takekoshi, both of Kawasaki, Japan

[73] Assignee: Canon Kabushiki Kaisha, Tokyo, Japan

[21] Appl. No.: 645,540

[22] Filed: May 14, 1996

[30] Foreign Application Priority Data

| | | | |
|---|---|---|---|
| May 15, 1995 | [JP] | Japan | 7-140017 |
| Jul. 7, 1995 | [JP] | Japan | 7-196133 |
| Jul. 18, 1995 | [JP] | Japan | 7-205273 |

[51] Int. Cl.[6] ..... G03G 15/14

[52] U.S. Cl. ..... 399/299; 399/306; 399/310

[58] Field of Search ..... 399/299, 300, 399/303, 306, 313, 316, 310, 314

[56] References Cited

U.S. PATENT DOCUMENTS

| | | | |
|---|---|---|---|
| 4,171,157 | 10/1979 | Suzuki | 355/3 TR |
| 4,544,262 | 10/1985 | Kanemitsu et al. | 355/3 TR |
| 5,081,501 | 1/1992 | Waki et al. | 355/274 |
| 5,119,139 | 6/1992 | Torisawa | 355/272 |
| 5,172,175 | 12/1992 | Sekino et al. | 355/277 |
| 5,225,879 | 7/1993 | Hayashida | 355/274 |
| 5,309,203 | 5/1994 | Hokari | 355/212 |
| 5,376,999 | 12/1994 | Hwang | 355/326 R |
| 5,594,538 | 1/1997 | Takekoshi et al. | 399/300 X |
| 5,600,421 | 2/1997 | Takekoshi et al. | 399/299 X |

*Primary Examiner*—R. L. Moses

*Attorney, Agent, or Firm*—Fitzpatrick, Cella, Harper & Scinto

[57] ABSTRACT

The present invention provides an image forming apparatus which comprises an image bearing member, a recording material bearing member for holding and conveying a recording material to a transfer portion, a transfer charge member for transferring an image from the image bearing member to the recording material born by the recording material bearing member, and an urging means for urging the rear surface of the recording material bearing member in the vicinity of the transfer portion. The transfer charge member being contacted with a rear surface of the recording material bearing member opposite to a front surface on which the recording material is held at the transfer portion.

47 Claims, 12 Drawing Sheets

IMAGE FORMING APPARATUS

BACKGROUND OF THE INVENTION

1. Field of the Invention

The present invention relates to an image forming apparatus utilizing a transfer process such as an electrostatic copying machine, an electrostatic printer and the like, and more particularly, it relates to an image forming apparatus suitable for effecting a multi transfer process.

2. Related Background Art

In the past, in color image forming apparatus of electrophotographic type or electrostatic recording type, there has widely been used a multi transfer method in which various color visualized images are successively transferred onto a recording material born on a recording material bearing member. Now, techniques and problems of conventional image forming apparatuses will be described in connection with a general color image forming apparatus having various advantages that high recording ability can easily be achieved and various recording requirements regarding a straight convey path can also be achieved, as shown in FIG. 7.

A transfer belt (recording material bearing member) 108 supports a recording material 6 such as a paper sheet and conveys the recording material to four image forming portions Pa, Pb, Pc and Pd. The image forming portions Pa to Pd includes drum-shaped image bearing members 101*a*, 101*b*, 101*c* and 101*d*, and process means for effecting image forming process to the image bearing members, and four color toner images are transferred to the image bearing members onto the recording material in a superimposed fashion by means of a transfer charger means. Thereafter, the recording material is separated from the transfer belt and then is sent to a fixing device (not shown). In the fixing device, while the recording material is being passed through a nip between a fixing roller and a pressure roller, four color toner images are fuzed and mixed.

In the image forming portions Pa to Pd, the transfer charger means have transfer charge members 104*a*, 104*b*, 104*c* and 104*d* contacted with a back surface of the transfer belt.

However, in the conventional color image forming apparatus shown in FIG. 7, the transferring operations are repeated in a condition that peel discharge due to separation (peel) of the toner from the image bearing members cannot be controlled. As a result, when the toner images are successively transferred onto the recording material in a superimposed fashion, the toner image once transferred to the recording material is re-transferred onto the image bearing member during the transferring of the next toner image, thereby causing the deterioration of the image. Further, pre-transfer discharge is generated at an upstream side of each transfer charge member, thereby causing the poor image.

On the other hand, in the above conventional technique, since the close contact between the image bearing members and the recording material and between the image bearing members and the recording material bearing member is maintained by the transfer charge members (conductive rubber plates) and associated urging members, the stable conveying ability for the recording material is often contradictory to the transferring ability. An example of this will be explained in connection with the color image forming apparatus shown in FIG. 7.

First of all, during the image formation, when the recording material 6 is supplied, the recording material is conveyed to the transfer belt 108 in response to the image forming timing. Then, the recording material is charged by the transfer charge member 104*a* to be absorbed to the transfer belt electrostatically. In this case, if the recording material is distorted or undulated, since electric field unevenness is generated during the transferring operations, uniform transferring cannot be achieved. That is to say, if any gap is created between the image bearing member 101*a*, recording material 6, transfer belt 108 and transfer charge member 104*a*, poor transferring is generated, resulting in the image unevenness. Although the image unevenness can be controlled or suppressed by increasing the urging force of the transfer charge member 104*a*, if the urging force of the transfer charge member is too great during the transferring operation, the toner particles are condensed to increase the intimacy between the toner and the image bearing member, thereby reducing the transferring efficiency. This is noticeable, particularly in a central portion of fine line. Thus, in order to avoid such inconvenience, there has been proposed a transfer charge member having weak urging force.

Further, if the urging force of the transfer charge member is great, the conductive rubber blade is worn greatly. As a result, during the transfer charging, a gap is created between the recording material and the conductive rubber blade, thereby causing a discharge phenomenon or improper electric field to worsen the service life.

Further, there is a problem regarding a both-face recording mode. That is to say, in a multi-color image forming apparatus (for example, four color (full-color) image forming apparatus), since four color toner images are superimposed on the recording material, the fusing and mixing ability of the fixing device must be increased. If the fusing and mixing ability if poor, many air gaps are generated between the toner particles, with the result that, due to scattering of light in interfaces between the toner particles and air, the color tones of the toner colors are deteriorated or a lower layer color is concealed by an upper layer color to reduce the reproduction of the actual colors.

In order to satisfy the fusing and mixing ability, so-called sharp-melt toner having low softening point and low fusing viscosity has been used. In this way, it is possible to improve the reproduction of the actual colors, thereby obtaining a color copy corresponding to an original. However, since the sharp-melt toner has great intimacy, there arises a problem that the toner is easily offset to the fixing roller.

Further, the recording material on which four toner images were superimposed is heated and pressurized in the fixing device. Accordingly, the toner having the great intimacy is apt to be transferred and adhered to the fixing roller by heat. If the toner is transferred to the fixing roller, the transferred toner will be transferred to a next recording material or be cured on the fixing roller, thereby causing the poor image.

In order to avoid such poor image, mold releasing agent is used. Before the toner images are fixed to the recording material in the fixing device, liquid mold releasing agent such as oil is coated on the fixing roller. By doing so, when the toner images are heated and pressurized, the fixing roller is not directly contacted with the toner images on the recording material but is contacted with the toner images via the mold releasing agent, thereby effectively preventing the toner from transferring to the fixing roller.

However, in a both-face copy mode, when an image is formed on a second surface (back surface) of the recording material, the mold releasing agent transferred from the fixing roller to a first surface (front imaged surface) of the recording material is transferred onto the transfer belt since the first surface is contacted with the transfer belt. Thereafter, the mold releasing agent transferred to the transfer belt is transferred to the image bearing member contacted with the transfer belt. The mold releasing agent adhered to the image bearing member can not be removed by a cleaning device for exclusively removing residual toner from the image bearing member. Thus, due to the presence of the mold releasing agent on the image bearing member, the residual toner and the toner from the developing devices are adhered to portions of the image bearing member where the toner should not be adhered, and, since such toners are subsequently transferred onto the recording sheet, the smudged image is obtained.

In this way, if during the both-face image formation, if the urging force of the transfer charger means is great, the mold releasing agent is transferred to the transfer belt and then to the image bearing member more and more, with the result that an additional mold releasing agent removing means is subjected to the great load.

SUMMARY OF THE INVENTION

An object of the present invention is to provide an image forming apparatus which can stabilize peel discharge during transferring operations.

Another object of the present invention is to provide an image forming apparatus which can effectively perform multi transferring operations without re-transferring.

A further object of the present invention is to provide an image forming apparatus which can achieve good conveying stability of a recording material and good transferring ability.

A still further object of the present invention is to provide an image forming apparatus in which, when images are formed on both surfaces of a recording material, adhesion of mold releasing agent to an image bearing member can be suppressed.

A further object of the present invention is to provide an image forming apparatus which can suppress pre-transfer discharge.

The other objects and features of the present invention will be apparent from the following detailed explanation of the invention with reference to the accompanying drawings.

DETAILED DESCRIPTION OF THE PREFERRED EMBODIMENTS

The present invention (image forming apparatus) will now be explained with reference to the accompanying drawings.

Figure 3:
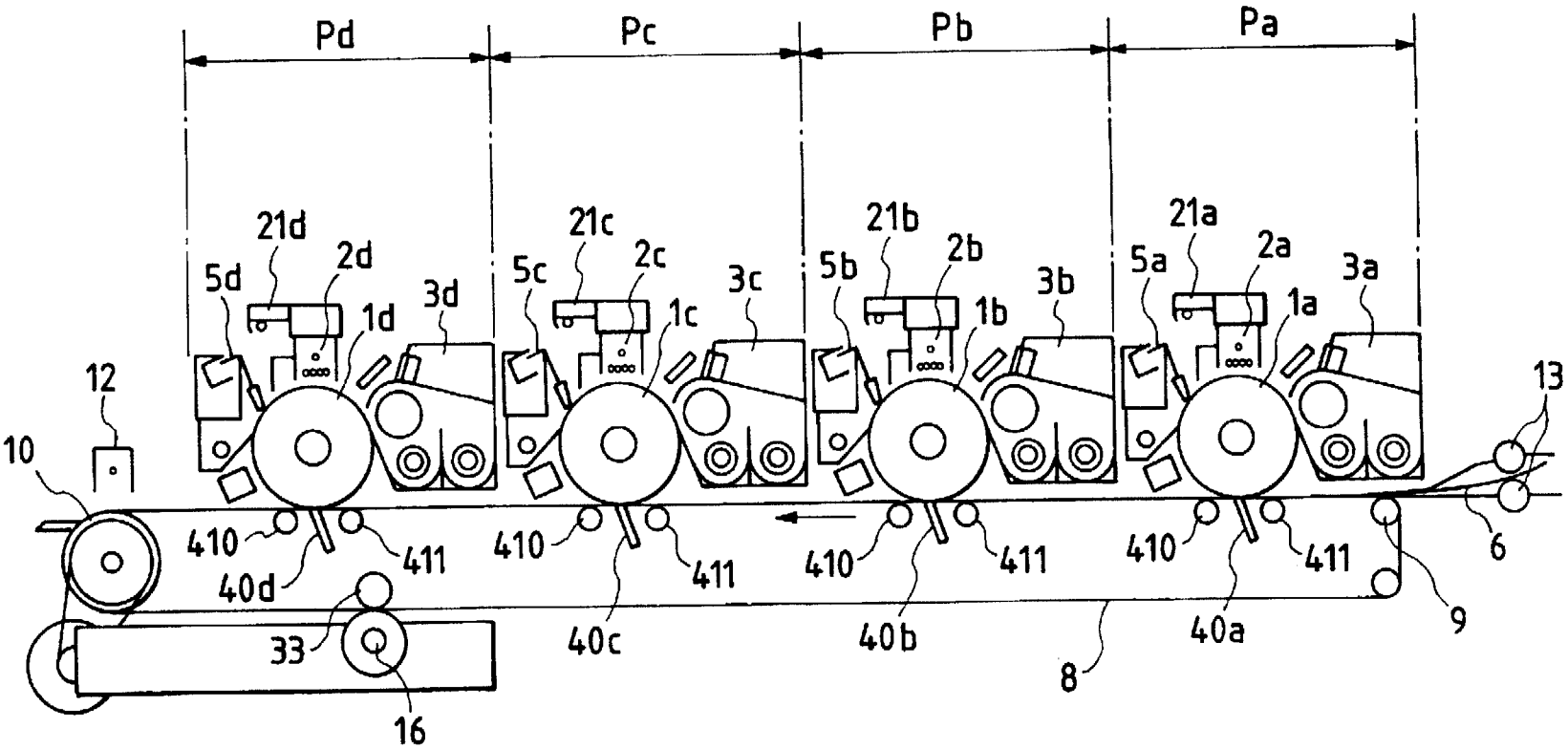
FIG. 3 is an elevational sectional view showing an example of the image forming apparatus according to the present invention.
Figure 6:
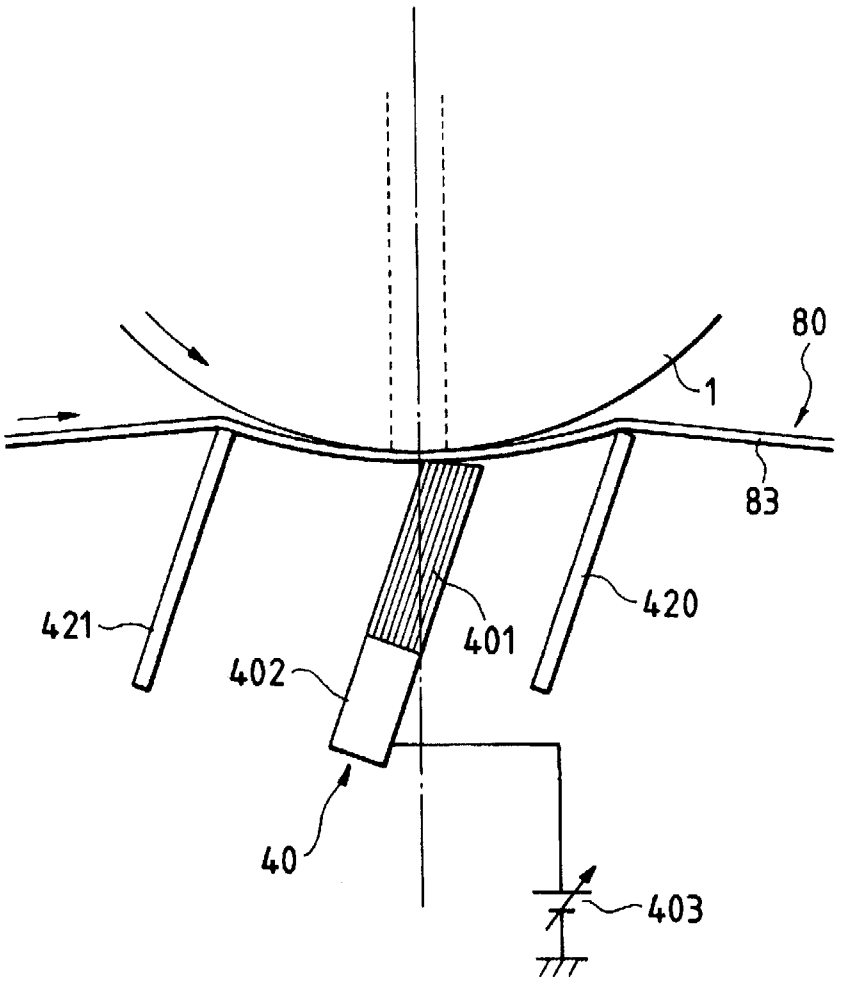
FIG. 6 is a sectional view showing an example of a transfer portion.

In FIG. 3 showing an example of an image forming apparatus according to a preferred embodiment as a sectional view, a color image forming apparatus includes an endless belt (transfer belt) 8 moved in a direction shown by the arrow X. A recording material 6 supplied from a cassette 60 is sent to the belt 8 through a pair of regist rollers 13, and the recording material is conveyed to the left (in FIG. 1) by the belt 8. Above the transfer belt 8, there are disposed four image forming portions Pa, Pb, Pc and Pd having the same construction and disposed side by side.

The image forming portion Pa includes an image bearing member 1*a* around which an image forming means comprised of a first charger 2*a*, a developing device 3*a* and a cleaner 5*a* is disposed. Similar to the image forming portion Pa, the image forming portions Pb, Pc and Pd include image forming means (2*b* to 2*d*, 3*b* to 3*d*, 5*b* to 5*d*). In the developing devices 3*a*, 3*b*, 3*c* and 3*d* of the image forming portions Pa to Pd, magenta toner, cyan toner, yellow toner and black toner are contained, respectively. Since the image forming portions Pa to Pd have the same construction, the first image forming portion Pa is mainly described hereinafter.

After the surface of the image bearing member 1*a* is uniformly charged by the first charger 2*a*, an image signal corresponding to magenta color component of the color on the original is incident on the image bearing member 1*a* through an exposure device (not shown) such as a polygon mirror, thereby forming an electrostatic magenta color component latent image on the image bearing member 1*a*. Then, magenta toner is supplied from the developing device 3*a* to the image bearing member 1*a* to develop the latent image as a magenta toner image. As the image bearing member 1*a* is rotated, when the magenta toner image reaches a transfer portion where the image bearing member 1*a* is contacted with the transfer belt 8, a recording material supplied from a cassette 60 also reaches the transfer position, with the result that the magenta toner image on the image bearing member 1*a* is transferred onto the recording material 6 by applying transfer bias to a transfer charger means 40*a*. Thereafter, residual toner remaining on the image bearing member 1*a* is removed by the cleaner 5*a*, and residual charges are removed by a pre-exposure means 21*a*. In this way, the image bearing member 1*a* is prepared for next image formation.

Until the recording material 6 bearing the magenta toner image thereon is conveyed to the next image forming portion Pb by the transfer belt 8, a cyan toner image is formed on the image bearing member 1*b* in the same manner as described above, and the cyan toner image is transferred onto the recording material in a superimposed fashion at the transfer portion of the image forming portion Pb. Similarly, whenever the recording material 6 passes through the image forming portions Pc and Pd, yellow toner image and black toner image are successively transferred onto the recording material in a superimposed fashion at respective transfer portions.

Thereafter, the recording material 6 is separated from a downstream (in a conveying direction) end of the transfer belt 8 and then is sent to a fixing device (not shown). The fixing device comprises a fixing roller and a pressure roller urged against the fixing roller. While the recording material 6 is being passed through a nip between the fixing roller and the pressure roller, four color toner images are fused, mixed and fixed to the recording material by heat and pressure, thereby forming a full-color image on the recording material. Thereafter, the recording material is discharged out of the color image forming apparatus.

At a downstream (in the conveying direction) side of the black toner image forming portion Pd, there are provided an electricity removing charger 12 and a cleaning fur brush 16 so that toner and charges can be removed from the transfer belt 8.

Incidentally, after the image was fixed to one surface of the recording material 6, the recording material 6 may be turned up (reversely rotated) automatically or manually and then be conveyed to the image forming portion Pa again, thereby forming an image on the other surface of the recording material.

The transfer belt 8 is made of dielectric resin such as polyethylene terephthalate resin (PET), polyvinylidene fluoride resin (PVdF), polycarbonate resin (PC), polyurethane resin (PU) and polyimide resin (PI) or rubber material, and the dielectric resin or rubber material is mixed with conductive filler so that the transfer belt 8 has proper electrical feature and strength.

The transfer charge members 40*a* to 40*d* shown in FIG. 3 can be formed from blades or rollers made of conductive elastomer, foam or fibers.

[Embodiment 1]

Figure 1:
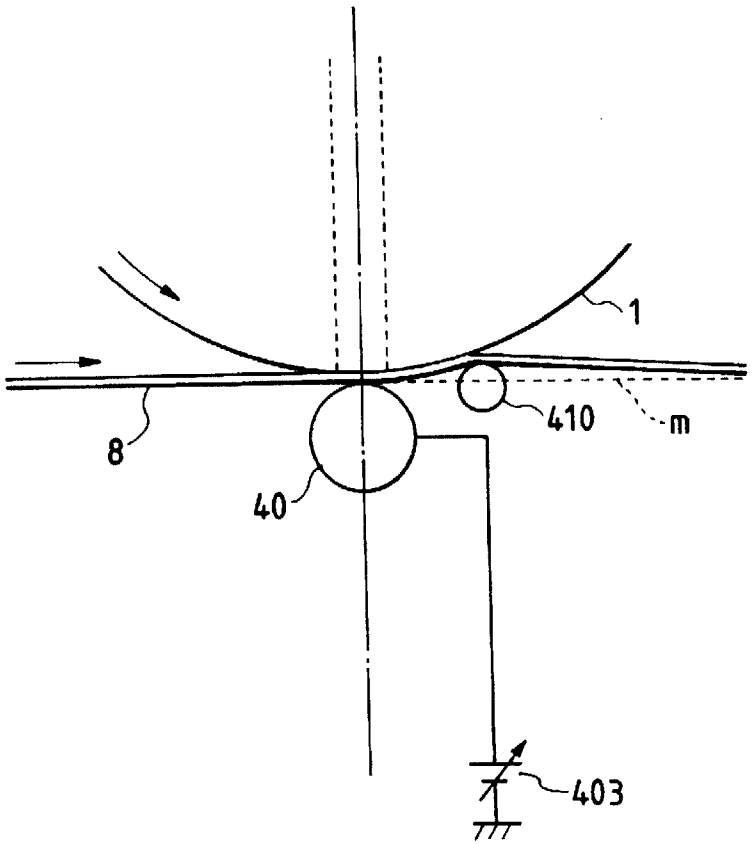
FIG. 1 is an explanatory view showing an example of a transfer portion of an image forming apparatus according to the present invention.

FIG. 1 is an enlarged view showing an example of a transfer portion applicable to the apparatus shown in FIG. 3. As shown in FIG. 1, a transfer charge member 40 disposed at the transfer portion and formed from, for example, a conductive roller made of conductive foam rubber is contacted with an image bearing member 1 via a transfer belt (recording material bearing member) 8. This contact point between the transfer charge member 40 and the image bearing member 1 is referred to as "transfer nip" hereinafter. At a downstream side of the transfer nip in a belt shifting direction, there is disposed an urging-up member 410 (referred to as "downstream urging-up member" hereinafter).

In the illustrated embodiment, during the transferring operation, the transfer belt 8 is urged upwardly by the downstream urging-up member 410 to elastically deform a portion of the belt at a downstream side of the transfer nip, thereby urging the transfer belt against the image bearing member 1. Preferably, the urging of the transfer belt against the image bearing member is selected so that a downstream area influenced by transfer electric field generated by the transfer charge member 40 is generally covered by contact area between the image bearing member 1 and the transfer belt 8. The dot line m is a tangential line tangent to the image bearing member 1 at the transfer nip (i.e. line connecting between the transfer nip and a support start position of a roller 10 shown in FIG. 3). The position where the transfer belt is pushed upwardly by the urging-up member 410 is protruded upwardly from the line m.

It is preferable that a distance between the transfer nip and the position where the transfer belt is urged by the urging-up member 410 is 5 mm to 30 mm, and the position where the transfer belt is urged by the urging-up member 410 is protruded upwardly from the line m by 0.5 mm to 5 mm, preferably, 1 mm to 1.5 mm.

Further, urging pressure of the urging-up member 410 against the transfer belt is preferably greater than urging pressure of the transfer charge member against the transfer belt. That is to say, when a thick recording material is conveyed by the transfer belt, it is preferable that the vibration of the transfer charge member due to resiliency of the recording material is minimized and the urging-up member 410 can easily be shifted.

With the arrangement as mentioned above, regarding the toner image transferred from the image bearing member 1 to the recording material (not shown), the peel of the toner image from the image bearing member 1 is effected at the area (downstream of the transfer nip) which is not influenced by the transfer electric field or where the transfer electric field is weakened, the peel discharge caused by the peel of the toner can be suppressed.

In general, the transferred toner images forms toner layers on the recording material. However, since the uppermost layer is spaced apart from the recording material more than the other toner layers, has an electrostatic holding force smaller than the other toner layers, and is contacted with the image bearing members by several times to be subjected to intimacy or reflection, the uppermost toner layer is apt to be re-transferred onto the image bearing members during the transferring operations. Furthermore, if the charge on the toner is reversed from negative to positive or the charged amount of the toner is decreased due to the peel discharge, the re-transferring will be enhanced. In this case, if the peel discharge is great, the uniform toner image will be distorted due to the intensity distribution of the peel discharge.

To avoid this, in the illustrated embodiment, by suppressing the vibration of the recording material and the recording material bearing member during the peeling (which is one of factors for promoting the peel discharge), the peel discharge caused by the vibration is minimized so that the toner images can be transferred onto the recording material with the stable electrostatic absorbing force. Accordingly, for example, in the case where a second color toner image is transferred onto a first color toner image on the transfer material in a superimposed fashion, when the first color toner image is contacted with the second image bearing member or when the transfer electric field is applied, it is possible to prevent the reversed first color toner image from being re-transferred ont the second image bearing member.

In the above-mentioned explanation, while an example that the transfer belt 8 is contacted with the image bearing member 1 by the urging-up member 410 at the downstream side of the transfer nip was explained, it is not necessary that the transfer belt is contacted with the image bearing member by the urging-up member, but, the transfer belt 8 may be merely pushed upwardly to be elastically deformed to prevent the vibration of the transfer belt during the rotation of the belt. In this case, since there is no vibration of the transfer belt 8 at the downstream side of the transfer nip, the fluctuation of the transfer electric field is suppressed, with the result that the peel discharge due to the peeling of the toner from the image bearing member at the downstream side of the transfer nip can be suppressed, thereby achieving the same object as mentioned above.

[Embodiment 2]

Figure 2:
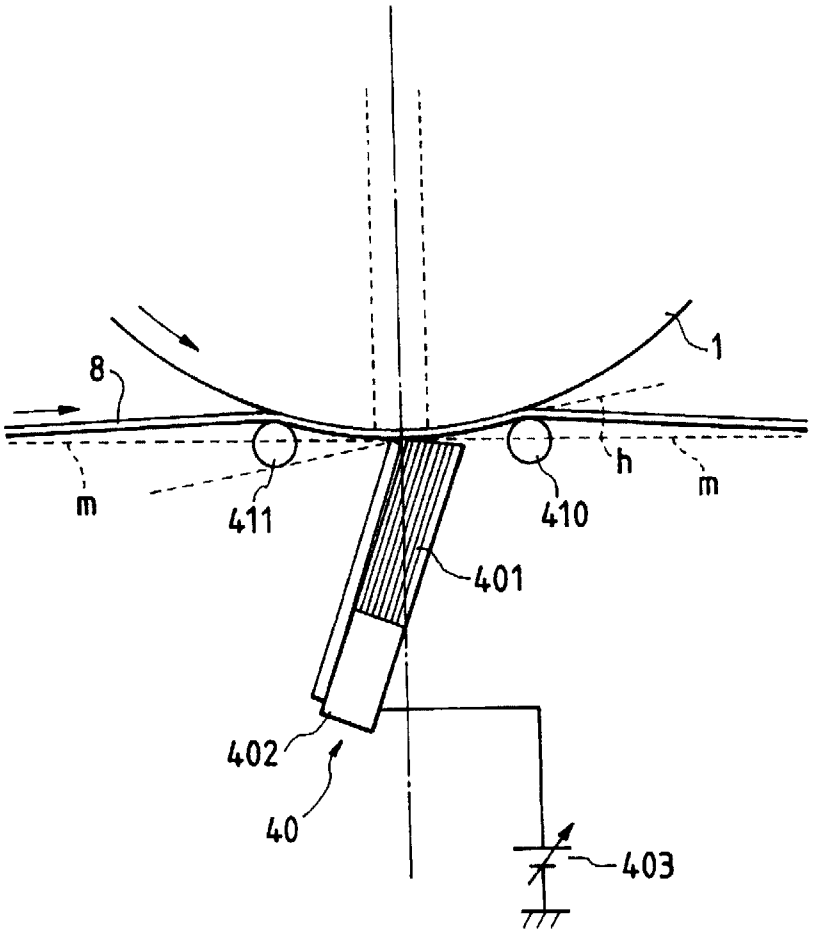
FIG. 2 is a sectional view showing an example of the transfer portion.

FIG. 2 is a sectional view showing another example of a transfer portion applicable to the apparatus shown in FIG. 3. As shown in FIG. 2, a transfer charge member 40 comprises a conductive brush including a plate-shaped electrode 402 and conductive fibers 401 mounted on the electrode. At the transfer portion of the image bearing member 1, a portion of the conductive fibers 401 is contacted with a back surface of the transfer belt 8, and remaining portion of the conductive fibers 401 is disposed in the vicinity of the back surface of the transfer belt. By applying high voltage from a high voltage source 403 (connected to the electrode 402) to the electrode, the transfer electric field is generated, thereby transferring the toner image on the image bearing member onto the recording material (not shown) supported by the transfer belt 8.

In this embodiment, similar to the aforementioned embodiment, since a downstream urging-up member 410 is disposed at a downstream side of the transfer nip of each of the image forming portions Pa to Pd so that the transfer belt 8 is pushed upwardly from the line m (FIG. 2) to be contacted with the image bearing member 1 at the downstream side of the transfer nip, it is possible to suppress the peel discharge due to the peeling of toner from the image bearing member during the transferring operation. Accordingly, the toner transferred to the recording material by the preceding transfer charge member can be prevented from being re-transferred onto the succeeding image bearing member, thereby obtaining a high quality color image stably.

Incidentally, the dot line m is a tangential line tangent to the image bearing member 1 at the transfer nip (i.e. line connecting between the transfer nip and a support start position of a roller 10 shown in FIG. 3), which coincide with a line connecting between the transfer nip and a support finish position of a roller 9.

In this embodiment, as shown in FIG. 2, in order to stabilize the transfer nip of the transfer charge member 40, an additional urging-up member (upstream urging-up member) 411 is disposed at an upstream side of the transfer nip. When the transfer belt 8 is pushed upwardly by the downstream urging-up member 410, since the transfer belt 8 is contacted with the image bearing member 1 along an inclined line h, if there is no upstream urging-up member 411, at a contact portion between the transfer charge member 40 and the transfer belt 8, the transfer belt 8 is lowered to apply the conductive fibers 401 to a downward urging force. When a thick recording material is used, such a downward urging force is increased, and, if the recording sheet is curled, such a downward urging force will be also increased.

In order to prevent such a downward urging force, the urging force of the conductive fibers 401 against the transfer belt 8, and, accordingly, the urging force of the conductive fibers 401 against the image bearing member 1 must be increased. However, during the transferring operation, it is preferable that the urging forces of the conductive fibers 401 and of the upstream urging-up member 411 for urging the image bearing member 1 are small because the toner particles are not compressed against the image bearing member 1. If any gap is created between the conductive fibers 401 and the transfer belt 8, the discharge is generated, thereby deteriorating the image quality.

The urging forces of the urging-up members 410, 411 against the transfer belt 8 is preferably smaller than the urging force of the transfer charge member 40 against the transfer belt 8. It is preferable that a distance between the position where the transfer belt is urged by the transfer charge member and the positions where the transfer belt is urged by the urging-up members 410, 411 is 5 mm to 30 mm, and the positions where the transfer belt 8 is urged by the urging-up members 410, 411 is protruded upwardly from the line m by 0.5 mm to 5 mm, preferably, 1 mm to 1.5 mm.

In this embodiment, as mentioned above, since the upstream urging-up member 411 is added, the conductive fiber 401 is prevented from being depressed by the transfer belt 8 pushed upwardly by the downstream urging-up member 410, thereby avoiding the excessive urging force against the image bearing member 1.

[Embodiment 3]

Figure 4:
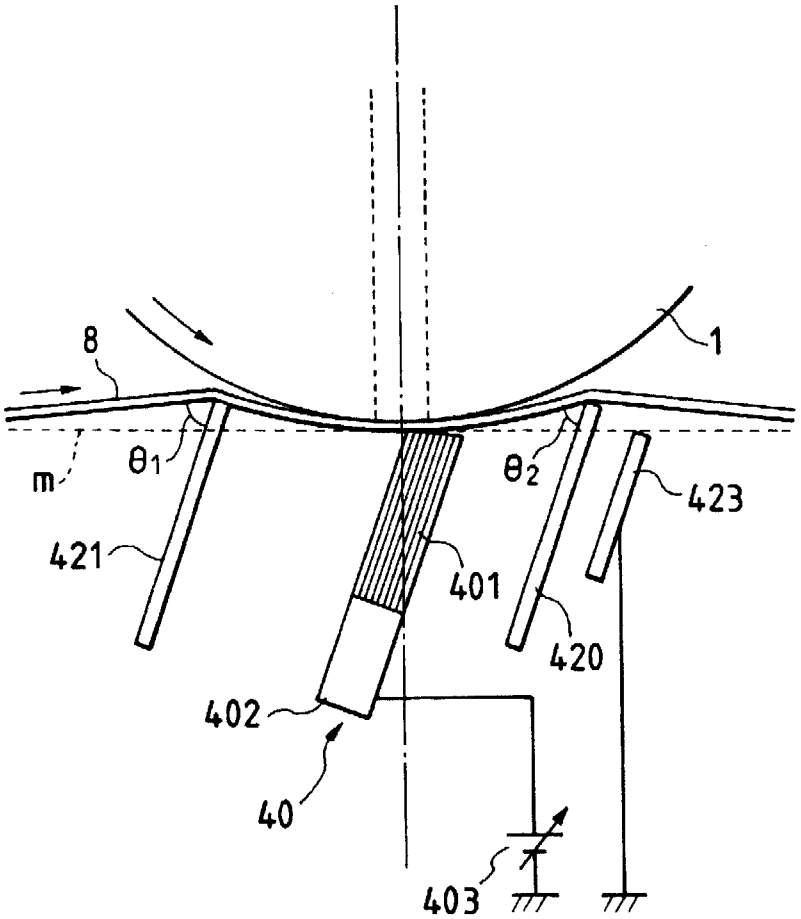
FIG. 4 is a sectional view showing an example of a transfer portion.

This embodiment relates to a still further example of a transfer portion which can be applied to the apparatus shown in FIG. 3. The urging-up member is not limited to a roller shape as mentioned above. Further, even when the transfer belt (recording material bearing member) elastically deformed by the urging-up member is not contacted with the image bearing member, the advantage of the present invention can be achieved. Such an example is shown in FIG. 4.

In this embodiment, a downstream urging-up member 420 and an upstream urging-up member 421 are constituted by plates each having a thickness of 500 μm and formed from polyethylene terephthalate film. Further, an electricity removal probe 423 formed from a grounded (earthed) saw-like stainless member is disposed at a downstream side of the downstream urging-up member 420 as shown so that, when the transfer belt 8 is not pushed upwardly by the urging-up members 420, 421, a tip end of the electricity removal probe 423 is contacted with the transfer belt 8 (shown by the line m). It is preferable that an upstream angle $\theta_1$ between the belt 8 and the upstream urging-up member 421 and an upstream angle $\theta_2$ between the belt 8 and the downstream urging-up member 420 are acute angles, respectively.

When the transfer belt 8 bearing the recording material is passed through the contact position between the bet and the transfer charge member 40, the electricity removal probe 423 serves to neutralize the peel discharge by applying the charges to the transfer belt 8. Thus, by using the electricity removal probe 423 together with the downstream urging-up member, the charged condition between the transferred uppermost toner image and the back surface of the transfer belt 8 immediately below the toner image can be maintained in a good condition. Incidentally, the electricity removal probe 423 may be disposed between the transfer charge member 40 and the downstream urging-up member 420.

The urging-up members 420, 421 are provided for stabilizing the running of the transfer belt 8. That is to say, by lifting the transfer belt 8 above the line m, the up-and-down vibration of the transfer belt 8 during the rotation of the belt can be prevented, thereby suppressing the fluctuation in electric field in the vicinity of the transfer nip. Thus, also in this case, the fluctuation in electric field during the multi transferring can be suppressed, the peel discharge due to the peeling of the toner during the transferring operations can be stabilized, and the high quality color image can be obtained by the multi transferring operations. Further, in order to prevent the damage of the transfer belt 8, the transfer belt 8 may be spaced apart from the image bearing member 1 at the positions where the transfer belt is urged by the urging-up members 420, 421.

[Embodiment 4]

Figure 5:
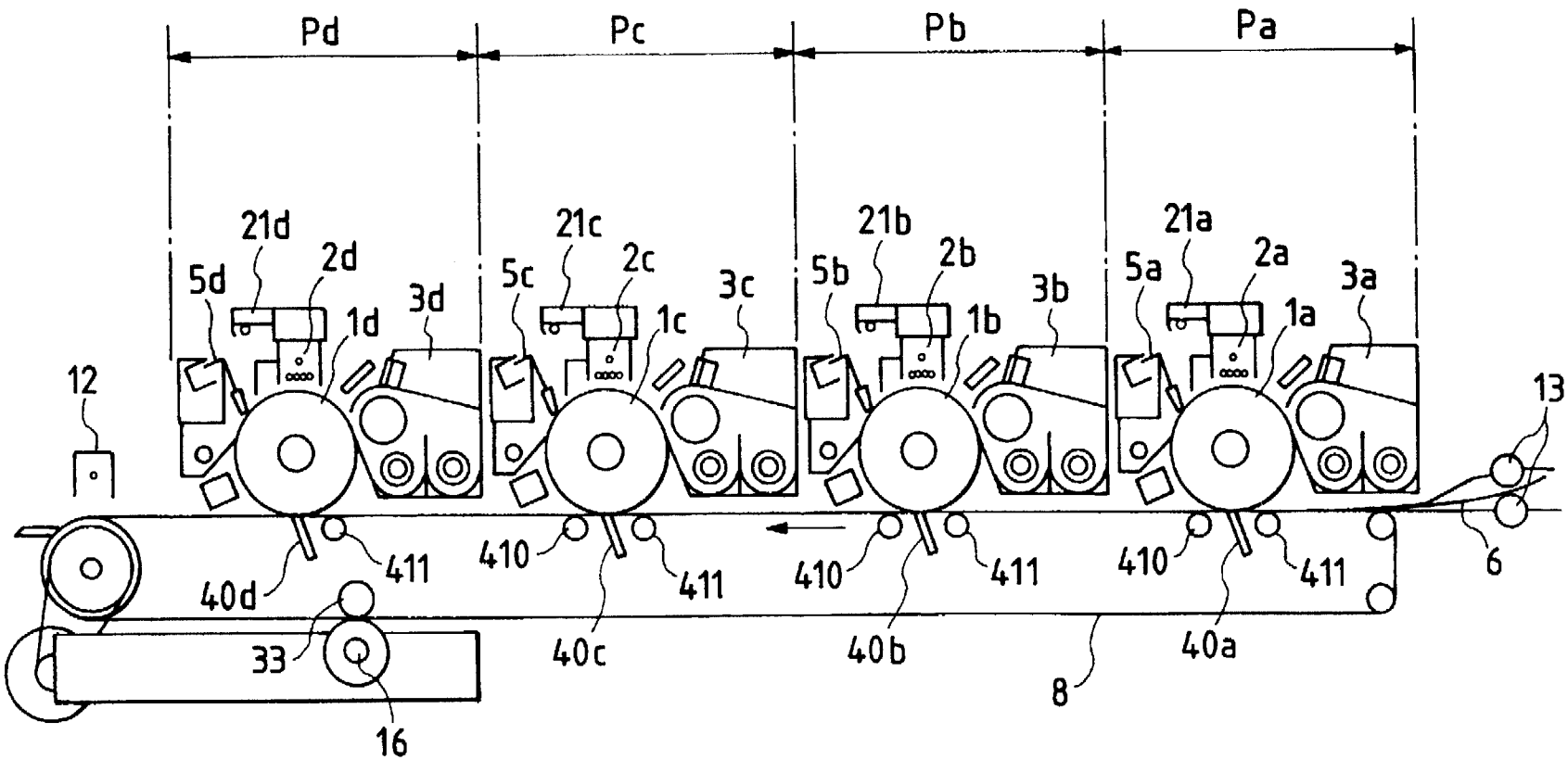
FIG. 5 is an elevational sectional view showing an image forming apparatus having the transfer portion of FIG. 4.
Figure 7:
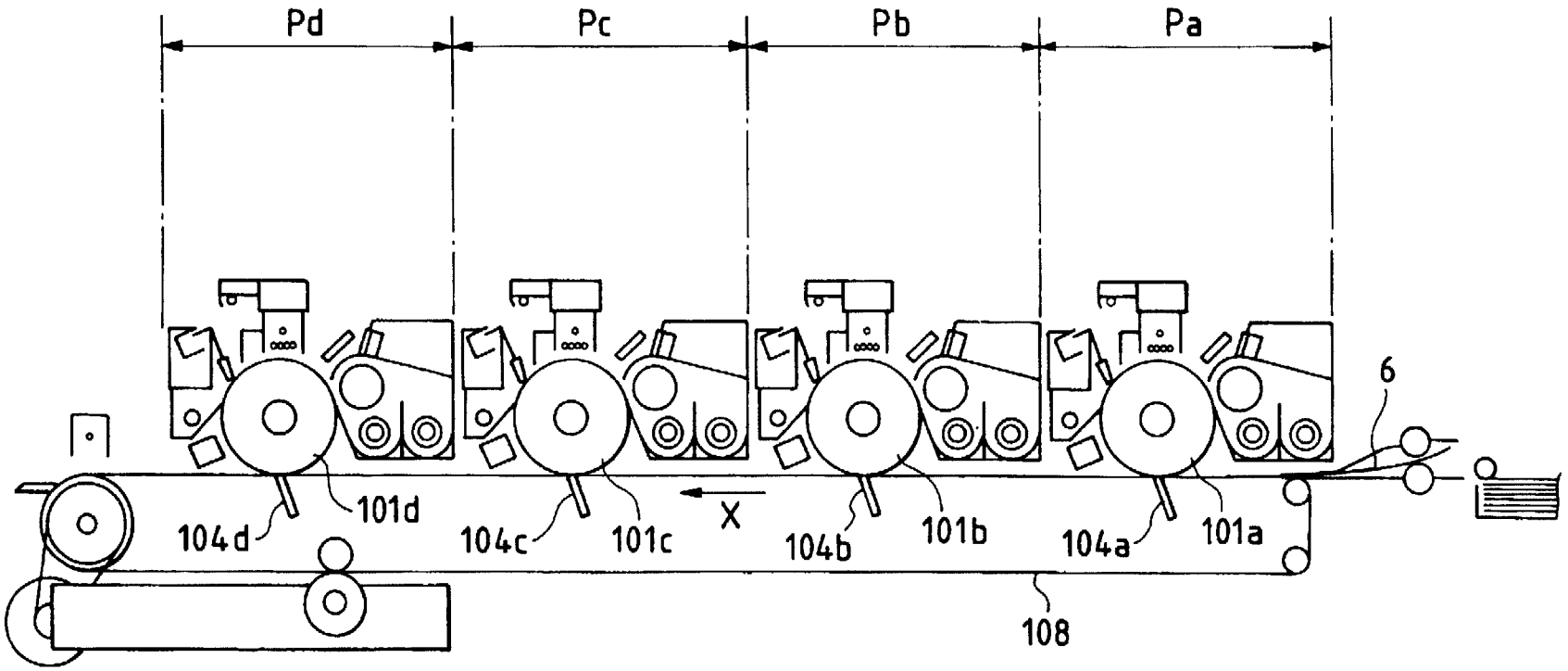
FIG. 7 is an elevational sectional view showing a conventional image forming apparatus.

It is not necessary that the urging-up members are provided in the same manner regarding all of the transfer charge members in the color image forming apparatus. An example is shown in FIG. 5. That is to say, in this embodiment, the downstream urging-up member 410 is omitted regarding the last color image forming portion Pd in the color image forming apparatus shown in FIG. 3. Even when the downstream urging-up member 410 is omitted regarding the last color image forming portion, the re-transferring of the toner can be prevented. This is the reason why, if the peel discharge is generated in the last color image forming portion Pd, since there is no further downstream image forming portion and thus no image bearing member, the toner is not re-transferred any more.

However, the upstream urging-up member 411 may be provided to stabilize the upstream side of the transfer nip of the last color image forming portion Pd.

Of course, the downstream urging-up member 410 may be provided in the last color image forming portion Pd, as well as the color image forming portions Pa to Pc. In this case, since all of the downstream urging-up members may be identical, the cost-down can be achieved. Further, when the peel discharge is prevented in the last color image forming portion Pd by pushing the transfer belt 8 upwardly by the downstream urging-up member 410, even during the subsequent processes such as electricity removal separation, fixing and the like, the image transferred to the recording material is not distorted.

[Embodiment 5]

Figure 8:
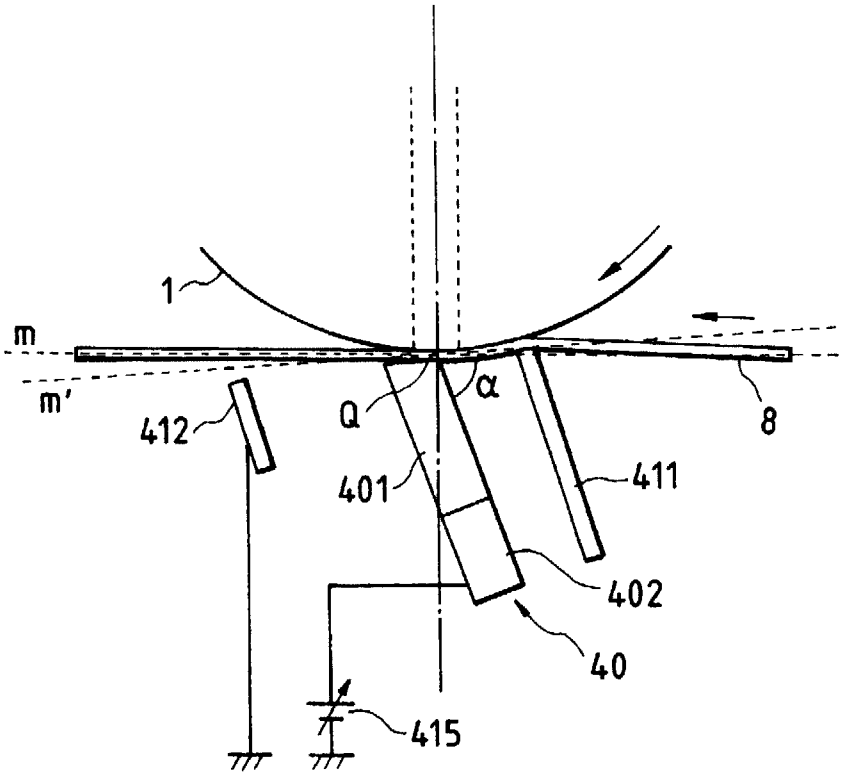
FIG. 8 is a sectional view showing an example of a transfer portion.
Figure 9:
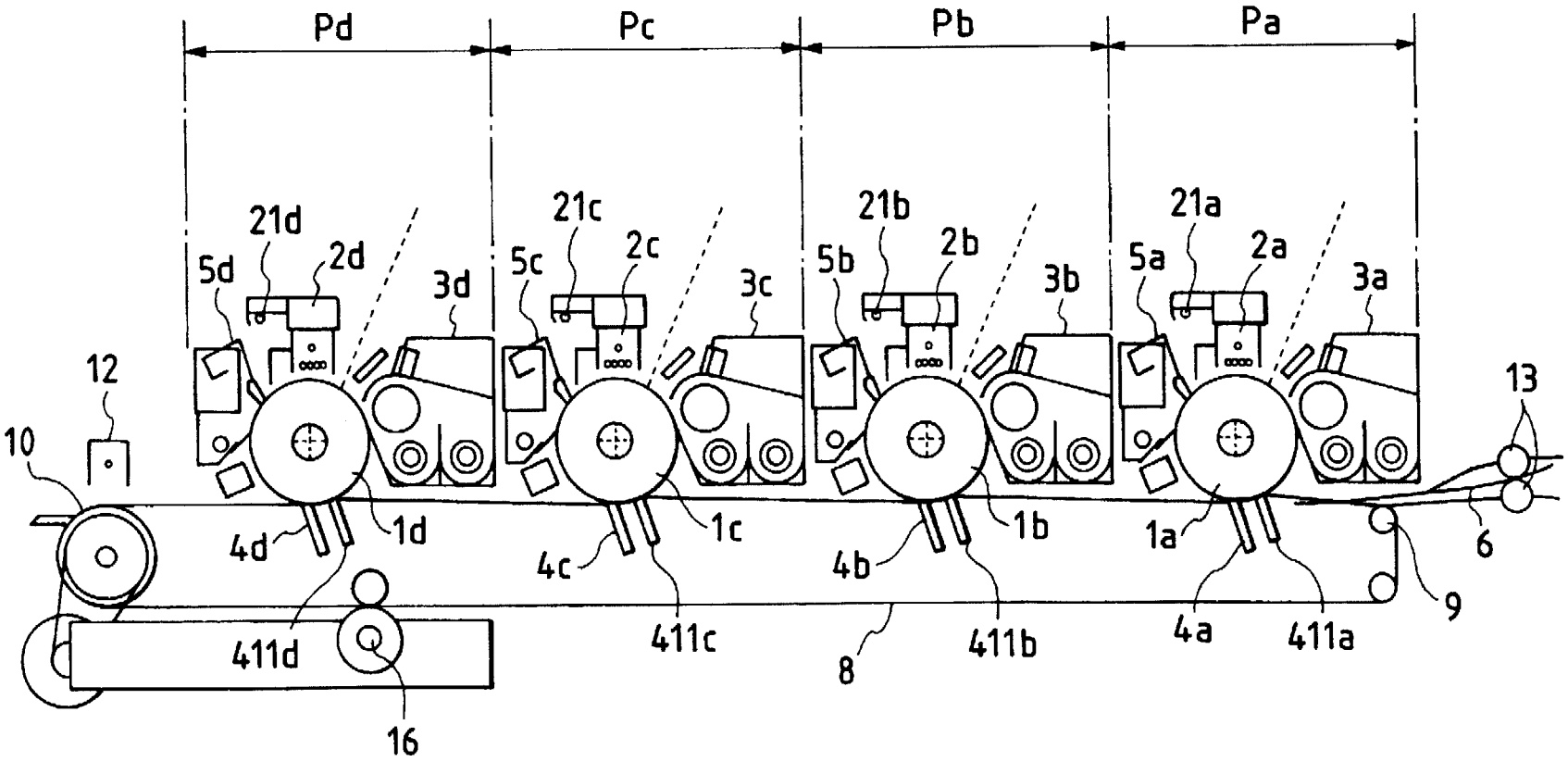
FIG. 9 is an elevational sectional view showing an example of the image forming apparatus according to the present invention.

A further example of an image forming apparatus and a transfer portion according to the present invention is shown in FIGS. 8 and 9. Similar to the image forming apparatus shown in FIG. 3, the image forming apparatus shown in FIG. 9 serves to form images on both surfaces of a recording material. The same elements as those of the apparatus of FIG. 3 are designated by the same reference numerals and explanation thereof will be omitted.

In FIGS. 8 and 9, a transfer charge member 40 is disposed in a confronting relation to a photosensitive drum (image bearing member) 1 with the interposition of an endless belt (recording material bearing member) 8. The transfer charge member 40 is constituted by a plate-shaped conductive rubber blade 401 and an electrode 402, and a tip end of the conductive rubber blade 401 urges the endless belt 8 against the photosensitive drum 1. The electrode 402 is connected to high voltage applying means 415. Further, an upstream urging-up member 411 is disposed at an upstream (in a belt shifting direction) side of a contact position where the endless belt 8 is contacted with the conductive rubber blade 401. This contact position is referred to as "transfer nip" hereinafter. In addition, an electricity removal probe 412 is disposed at a downstream side of the transfer nip.

As shown in FIG. 8, the upstream urging-up member 411 supports the endless belt 8 in such a manner that the line m tangent to a lowermost point Q of the photosensitive drum 1 is bent by the upstream urging-up member to be contacted with the line m' passing through the lower most point Q and inclined downwardly from the upstream side to the downstream side. Incidentally, the line m is the same as those shown in FIGS. 1, 2 and 4.

When the recording material 6 is a paper sheet having no flatness by repeating the absorbing/discharging of moisture, the transfer electric field can be applied in a condition that the upstream urging-up member 411 is positioned along the endless belt 8 while squeezing the recording material 6. If there is no upstream urging-up member 411, since the conductive rubber blades 401 applies the transfer electric field while squeezing the recording material 6, the electric field is also applied to the upstream side of the transfer nip, thereby causing the uneven application of the electric field.

Further, in comparison with the case where the recording material 6 is squeezed by the conductive rubber blade 401 alone, when the upstream urging-up member 411 is used together with the conductive rubber blade, the pressure can be reduced because the same total pressure can be dispersed. That is to say, the toner condensation on the photosensitive drum due to the local pressure concentration can be avoided. As a result, the transfer void and/or wear of the conductive rubber blades can be prevented.

In this embodiment, the upstream urging-up member 411 is formed from PET film having a thickness of 500 μm, and the total pressure of the conductive rubber blade and the upstream urging-up member is selected to 1 kg. Further, the electricity removal probe 412 is formed from a grounded saw-shaped stainless steel member.

With the arrangement as mentioned above, the squeezing force for the recording material 6 (or urging force of the conductive rubber blade) of 1 kg can be dispersed, thereby achieving the coexistence of the good conveying stability of the recording material and the good transferring ability.

As shown in FIG. 8, an upstream angle α between the blade 401 and the belt 8 is preferably an acute angle. Incidentally, as mentioned above, the pressure of the upstream urging-up member against the belt 8 is preferably smaller than the pressure of the conductive rubber blade 401 against the belt 8. The thickness of the conductive rubber blade 401 is 500 μm to 5 mm, and, preferably, 1.0 mm to 2.0 mm. It is preferable that the total pressure of the transfer charge member against the belt 8 is 100 to 1200 grams. Rubber hardness of the conductive rubber blade 401 is 20° to 80° (JIS A), and, preferably, 40° to 60°.

It is preferable that a distance between the position where the transfer charge member is urged against the belt 8 and the position where the upstream urging-up member is urged against the belt 8 is 5 mm to 30 mm. The urging position where the upstream urging-up member 411 is urged against the belt 8 is protruded above the line m by 0.5 mm to 5 mm, and, preferably, 1 mm to 1.5 mm.

Incidentally, in the illustrated embodiment, while an example that the upstream urging-up member 411 is disposed at the upstream side of the transfer charge member 40 in the belt shifting direction was explained, the present invention is not limited to such an example, but, for example, so long as the pressure can be dispersed and the wear of the conductive rubber blade can be prevented, the upstream urging-up member 411 may be disposed at the downstream side of the conductive rubber blade 401. In this case, the distance between the conductive rubber blade 401 and the urging-up member disposed at the downstream side of the conductive rubber blade is not fixed with respect to the contact point between the photosensitive drum 1 and the endless belt 8 as shown in FIG. 8.

[Embodiment 6]

This embodiment relates to another example of a transfer portion applicable to the apparatus shown in FIG. 9. While the urging-up member in the embodiment 5 was always urged against the belt, it is not necessary that the urging-up member is always urged against the belt.

As mentioned above, in the electrophotographic image forming apparatuses, mold releasing agent such as silicone oil is widely used in the fixing device. If the mold releasing agent is adhered to the endless belt, the mold releasing agent is gradually transferred onto the photosensitive drum, with the result that the toner adhesion is enhanced, thereby smudging the image.

One of factors for adhering the mold releasing agent to the endless belt is that, in the both-face copy mode, during the transferring of the toner image onto the second surface of the recording material and/or during the conveyance of the recording material, when the mold releasing agent adhered to the first imaged surface of the recording material is contacted with the endless belt, the mold releasing agent is transferred onto the endless belt. Thus, when the recording material is born on the endless belt for the second surface image formation at a position where the recording material is born on the endless belt for the first surface image formation or when recording sheets having different size are continuously used or when there is no space for bearing the recording material on the endless belt, the mold releasing agent on the endless belt may be transferred onto the photosensitive drum.

Therefore, in the embodiment 6, unlike to the embodiment 5, when the transfer electric field is not applied, the urging force of the urging-up member (together with the urging force of the transfer charge member) is released from the belt 8. In this way, the transferring of the mold releasing agent can be prevented.

[Embodiment 7]

In the embodiment 6, while an example that the urging force of the urging-up member together with the urging force of the transfer charge member is released from the belt 8 was explained, the present invention is not limited to such an example.

Figure 10:
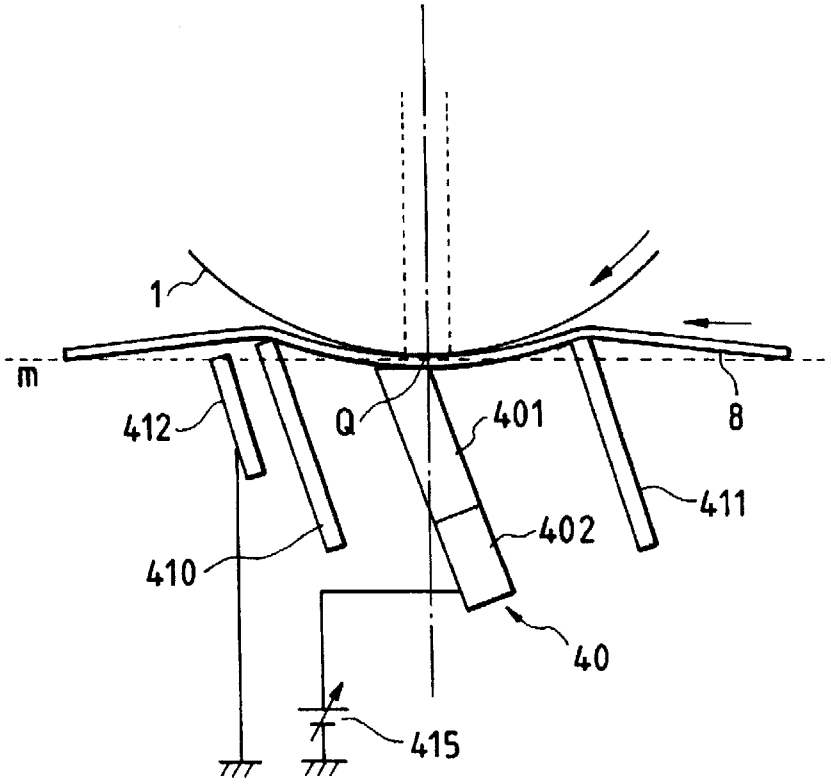
FIG. 10 is a sectional view showing an example of a transfer portion.

As shown in FIG. 10, in the embodiment 7, in addition to the upstream urging-up member 411, a downstream urging-up member 410 disposed at a downstream side of the transfer charge member 40 and at an upstream side of the electricity removal probe 412 in the belt shifting direction is also adopted. Now, this embodiment will be explained in connection with the case where it is applied to the image forming apparatus shown in FIG. 9.

As is in the color image forming apparatus shown in FIG. 9, the image forming apparatus having a plurality of image bearing members has an advantage that it can handle a recording material having strong resiliency with a straight sheet convey path. However, as is in this embodiment, when the upstream and downstream urging-up members 411, 410 are provided at the transfer portion, a temporarily curved convey path is formed. In this case, when the recording material having strong resiliency is conveyed, if there is no sufficient urging force, the upstream urging-up member 411, the downstream urging-up member 410 or the transfer charge member 40 will be pushed downwardly by the recording material.

In this case, if these elements 410, 411, 40 act on the endless belt 8 integrally or simultaneously, when one of these elements is pushed downwardly by the recording material, during the transferring operation, the conductive rubber blade 401 is separated from the endless belt 8, thereby causing the poor image due to the discharge. To the contrary, if the urging force is selected be strong enough that these element are not pushed downwardly by the recording material, not only the transfer charge member is apt to be worn, but also the conveying speed of the recording material is temporarily changed when the transferring operation is started and when the transferring operation is finished, thereby causing the deviation of colors.

To avoid this, in this embodiment, at least one of the upstream and downstream urging-up members 411, 410 is operated independently from the transfer charge member 40. With this arrangement, the above problem can be solved, and various kinds of recording materials can be handled with high image quality and the stable conveying ability can be achieved. Further, when the upstream and downstream urging-up members 411, 410 and the transfer charge member 40 are operated independently from each other, more excellent advantage can be achieved.

When a means for operating the elements 410, 411, 40 independently comprises a spring member and, for example, when the upstream urging-up member 411 is formed from an elastic member and the urging-up member 411 and the conductive rubber blade 401 are simultaneously pressurized by the spring member, if the elastic force of the urging-up member 411 is smaller than the pressurizing force of the spring member, the spring member pressurizes independently. For example, when the upstream urging-up member 411 is formed from PET film having a thickness of 100 μm and the elements 411, 40 are pressurized by a spring having total pressure of 1 kgf, the deformed amount can be absorbed by the flexion of the PET film, thereby achieving the above advantage. Particularly, when a sheet having a thickness greater than a plain sheet is used as the recording material, it is preferable that the deformed amount of the upstream urging-up member 411 becomes greater than the deformed amount of the transfer charge member 40 when the recording material is being passed through the transfer portion.

Next, the position of the upstream urging-up member will be described in detail.

If the upstream urging-up member is disposed closely near the contact position between the transfer charge member and the endless belt, i.e., is spaced apart from the contact position between the transfer charge member and the endless belt only by several hundred μm in accordance with the Paschen low, when the recording material is thick or when the image is formed on the second surface of the recording material or when the recording material is OHP sheet (in these cases, transfer potential of the transfer charge member becomes great), transfer pre-discharge will be generated.

That is to say, when the recording material is thick or when the image is formed on the second surface of the recording material or when the recording material is OHP sheet, since it is necessary to apply higher voltage to the transfer charge member in comparison with the plain sheet and since an area influenced upon the electric field of the transfer charge member is extended toward the upstream and downstream sides in accordance with the applied voltage, the upstream side of the contact position between the upstream urging-up member and the endless belt is influenced upon the electric field, thereby causing the transfer pre-discharge.

Further, since the recording material bearing member is constituted by the endless belt, the convey path (sheet path) to the transfer portion becomes unstable depending upon the conveying speed, thickness and size of the recording material and the like, and, thus, the gap width between the photosensitive drum and the endless belt (before the transferring) also becomes unstable. As a result, even in areas where the discharge is not generated normally, the discharge will generated if the gap width is decreased.

Further, in spite of the fact that the urging-up members are disposed at the upstream and downstream sides of the transfer charge member in order to prevent the transfer pre-discharge and the peel discharge, when the toner image is transferred from the photosensitive drum to the recording material, although there is no noticeable transfer void due to the discharge, the toner particles are scattered in dot unit, thereby causing the poor image.

Further, even when the upstream and downstream urging-up members for urging the endless belt upwardly during the transferring operation are urged against the endless belt with low pressure, since these urging-up members are urged against the moving endless belt, the friction inevitably occurs between the upstream and downstream urging-up members and the endless belt. Particularly, when the urging-up members are made of rubber or resin having high coefficient of friction with respect to the endless belt, the upstream and downstream urging-up members and the endless belt are worn greatly, and the urging-up members and the endless belt are vibrated. Accordingly, the urging-up members provided for preventing the transfer pre-discharge or peel discharge have no long service life.

Therefore, in the following embodiment, by properly regulating the position of the upstream urging-up member, the transfer pre-discharge which may be generated in the vicinity of and at the upstream side of the transfer charge member is suppressed without being influenced by fluctuation in potential due to the change in environmental condition, with the result that the transfer void is prevented with the latitude of the wider transfer range, thereby obtaining the good color image stably.

[Embodiment 8]

Regarding this embodiment, an example of an electrophotographic color copying machine will be briefly explained with reference to FIG. 17. The copying machine includes therein first to fourth image forming portions Pa, Pb, Pc and Pd disposed side by side so that different color toner images are formed through latent image formation, development and transfer processes.

In this embodiment, the image forming portions Pa to Pd have respective electrophotographic photosensitive drums 1*a*, 1*b*, 1*c* and 1*d*, respectively, on which different color toner images are formed, respectively. A recording material bearing member (transfer belt) 8 is disposed adjacent to the photosensitive drums 1*a* to 1*d* so that the different color toner images formed on the photosensitive drums 1*a* to 1*d* are transferred onto a recording material 6 supported on the transfer belt 8. The recording material P to which the color toner images were transferred is sent to a fixing device 32, where the toner images are fixed by heat and pressure. Thereafter, the recording material is discharged out of the copying machine as an imaged output sheet.

Around the photosensitive drums 1*a* to 1*d*, there are disposed exposure lamps 21*a*, 21*b*, 21*c* and 21*d*, drum chargers 2*a*, 2*b*, 2*c* and 2*d*, potential sensors 113*a*, 113*b*, 113*c* and 113*d*, developing devices 3*a*, 3*b*, 3*c* and 3*d*, contact transfer charge members 40*a*, 40*b*, 40*c* and 40*d*, and cleaners 5*a*, 5*b*, 5*c* and 5*d*. Further, light sources (not shown) and polygon mirrors 117 are disposed at an upper portion of the copying machine.

Light beams emitted from the light sources are scanned by rotating the polygon mirrors 117, and the scanned light beams are deflected by reflection mirrors and then are incident on the photosensitive drums 1*a* to 1*d* through fθ lenses to expose the drums, thereby forming latent images on the drums in response to image signals.

The developing devices 3*a*, 3*b*, 3*c* and 3*d* are filled with cyan toner, magenta toner, yellow toner and black toner, respectively, supplied from toner supplying devices (not shown). The latent images on the photosensitive drums 1*a* to 1*d* are developed by the developing devices 3*a* to 3*d*, respectively, to form a cyan toner image, a magenta toner image, an yellow toner image and a black toner image respectively.

The recording material 6 is supplied from a recording material cassette C to the transfer belt 8 through a plurality of pairs of convey rollers and a pair of regist rollers 13. The recording material on the transfer belt is successively sent to the transfer portions of the photosensitive drums 1*a* to 1*d* by the rotation of the transfer belt 8.

The transfer belt 8 is formed from dielectric resin sheet such as polyethylene terephthalate resin sheet (PET sheet), polyvinylidene fluoride resin sheet or polyurethane resin sheet, and, by interconnecting both ends of the resin sheet, an endless belt is obtained. Alternatively, a seamless endless belt may be used.

In case of a seamless endless belt, not only it is difficult to manufacture a belt having uniform property, but also it is not suitable for mass-production because of unevenness of peripheral lengths of belts, long manufacturing time and expensiveness. On the other hand, in case of a belt having a seam, since there are unevenness in the joint and change in resistance value in the joint, if the image is formed on the joint of the belt, the image will be distorted. In order to obtain the high quality image, it is preferable that the peripheral length of the transfer belt 8 is selected to be greater than the sum (total length) of a length of the recording material and a distance between two adjacent recording materials (sheet-to-sheet distance) by integral number times, and the image is not formed on the belt joint under the control of a belt joint position detecting means.

Regarding the belt joint position detecting means, when the transfer belt 8 is not transparent, an optical sensor of reflection type is used. In this case, a mark having a different reflection feature is provided on the belt joint so that the joint can be detected by the optical sensor. On the other hand, when the transfer belt 8 is transparent, an optical sensor of permeable type is used as the belt joint position detecting means to directly detect the joint, or a displacement sensor is used to mechanically detect a notch or a projection provided at the belt joint.

Further, when the transfer belt 8 is rotated by using a plurality of rollers, generally, the transfer belt is apt to be displaced or deflected toward a width-wise direction perpendicular to a rotational direction of the belt (i.e., thrust direction parallel with axes of support rollers), thereby causing the damage of the belt. The deflection of the transfer belt 8 is caused by a difference in peripheral lengths of the belt in the thrust direction, a difference in peripheral lengths of each support roller in the thrust direction or distortion of a belt support unit (which cause a difference in tension on the belt 8 in the thrust direction, thereby generating stress in the belt in the thrust direction).

In order to prevent the deflection of the transfer belt, for example, the transfer belt is provided at its back surface with ribs or guide holes (belt side deflection preventing mechanism), or, for example, a control mechanism for controlling the support rollers for the transfer belt is provided (belt rotating mechanism side deflection preventing mechanism). However, in any cases, it is rather hard to rotate the transfer belt 8 without deflection of the transfer belt in the thrust direction. Thus, it is desirable that the transfer belt 8 is rotated by repeating certain deflections of the belt in both thrust directions.

After the transfer belt 8 is rotated, when the fact that the belt is positioned at a predetermined position, the recording material 6 is sent from the pair of regist rollers 13 to the transfer belt 8, with the result that the recording material 6 is conveyed toward the transfer portion of the first image forming portion Pa. At the same time, an image formation start signal is emitted, with the result that the image is formed on the photosensitive drum 1*a* of the first image forming portion Pa at a predetermined timing. At the transfer portion of the photosensitive drum 1*a*, by applying the electric field or charges to a transfer charge brush 40*a*, the first color toner image formed on the photosensitive drum 1*a* is transferred onto the recording material 6. By this transferring operation, the recording material 6 is firmly held on the transfer belt 8 by an electrostatic absorbing force, and then is conveyed to the second image forming portion Pb.

Similarly, in the second to fourth image forming portions Pb to Pd, the image forming operations and the transfer operations are effected successively. Then, the electricity on the recording material 6 to which four toner images were transferred is removed by a separation charger 12 at a downstream portion of the transfer belt 8 to reduce the electrostatic absorbing force, with the result that the recording material is separated from the transfer belt 8 at its downstream end. The separated recording material is sent to the fixing device 32.

The fixing device 32 comprises a fixing roller 51, a pressure roller 52, heat resistive cleaning members 54, 55 for cleaning these rollers, roller heaters 56, 57 disposed within the rollers 51, 52, a coating roller 50 for coating mold releasing agent such as dimethyl silicone oil onto the fixing roller 51, an oil reservoir 53, and a thermistor 58 for detecting a temperature of a surface of the pressure roller 52 control the fixing temperature. In the fixing device, the four color toner images on the recording material 6 are fused, mixed and fixed, thereby obtaining a full-color image.

After the respective transferring operations, the residual toners remaining on the photosensitive drums 1*a* to 1*d* are removed by the respective cleaners 5*a*, 5*b*, 5*c* and 5*d* for preparation for next image formation. After the electricity is removed from the transfer belt by the electricity removal charger and a counter electrode, the toner adhered to the surface of the transfer belt 8 is removed by a cleaning web (non-woven fabric) 19 contacted with the front surface of the belt 8 and a back-up member 24 contacted with the back surface of the belt.

Figure 11:
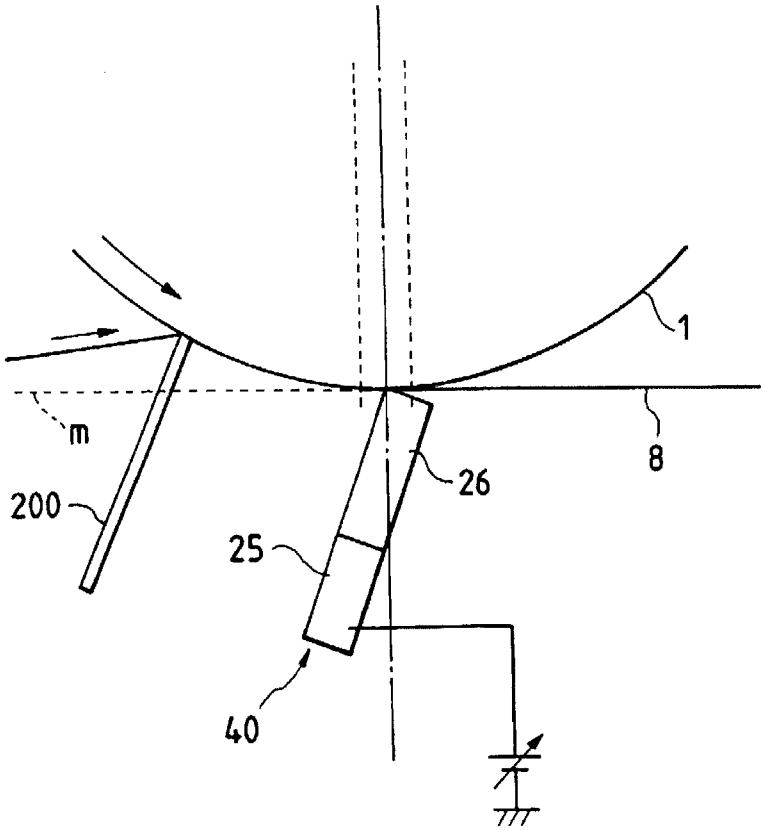
FIG. 11 is a sectional view showing an example of a transfer portion.

The transfer portion according to this embodiment is shown in FIG. 11. In the illustrated embodiment, the transfer portion is adopted to the transfer portion of each of first to fourth image forming portions Pa to Pd.

As shown in FIG. 11, the transfer portion has a transfer charge member 40 of contact type comprised of an electrode 25 and a plate-shaped conductive substrate (conductive blade) 26. The plate-shaped conductive substrate or conductive blade 26 has a thickness along a shifting direction of the transfer belt 8 and is inclined from an upstream side to a downstream side to extend toward the photosensitive drum 1 and is contacted with (or disposed closely adjacent to) the photosensitive drum 1 via the transfer belt 8.

In this embodiment, the conductive blade 26 is made of epichlorohydrin rubber including carbon black and having hardness of 50° (JIS A).

An urging-up member 200 is disposed at an upstream side of the transfer charge member 40. Similar to the conductive blade 26, the upstream urging-up member 200 is formed from a plate member having a thickness along the shifting direction of the transfer belt 8. The upstream urging-up member 200 is inclined from an upstream side to a downstream side to extend toward the transfer belt 8. During the transferring operation, the upstream urging-up member pushes the transfer belt 8 upwardly toward the photosensitive drum 1 at an upstream side of a contact position (transfer nip) between the conductive blade 26 and the transfer belt 8, thereby closely contacting the transfer belt with the photosensitive drum 1.

In the illustrated embodiment, the upstream urging-up member 200 is located at a position where the transfer belt 8 can be contacted with the photosensitive drum 1 by the upstream urging-up member 200 through an area of the photosensitive drum (at the upstream side of the transfer nip) which is influenced by the transfer electric field. In the illustrated embodiment, the upstream urging-up member 200 is disposed at an end of the area of the photosensitive drum (at the upstream side of the transfer nip) which is influenced by the transfer electric field so that the transfer belt 8 is contacted with the photosensitive drum 1 by the upstream urging-up member 200 to satisfy the above requirement.

Accordingly, the recording material is pinched between the transfer belt 8 and the photosensitive drum 1 from a point which is not influenced by the transfer electric field at the upstream side of the transfer nip, with the result that, the recording material is closely contacted with the photosensitive drum 1, the transferring operation is effected. Thus, the illustrated embodiment can prevent the pre-transfer discharge which was caused due to the small gap between the transfer belt and the photosensitive drum in the vicinity and at the upstream side of the transfer nip in the conventional apparatuses.

In the illustrated embodiment, while an example that the upstream urging-up member 200 is urged against the photosensitive drum 1 via the elastically deformed transfer belt 8 was explained, it is not necessary that the upstream urging-up member 200 is contacted with the photosensitive drum.

That is to say, the upstream urging-up member 200 may be disposed out of the end of the area (at the upstream side of the transfer nip) which is influenced by the transfer electric field, so that the transfer belt 8 is contacted with the photosensitive drum 1 up to the area (at the upstream side of the transfer nip) which is influenced by the transfer electric field, but the upstream urging-up member 200 itself is not contacted with the photosensitive drum 1, thereby positively supporting the transfer belt 8 to prevent the up-and-down vibration of the belt due to the rotation of the transfer belt 8.

Figure 12:
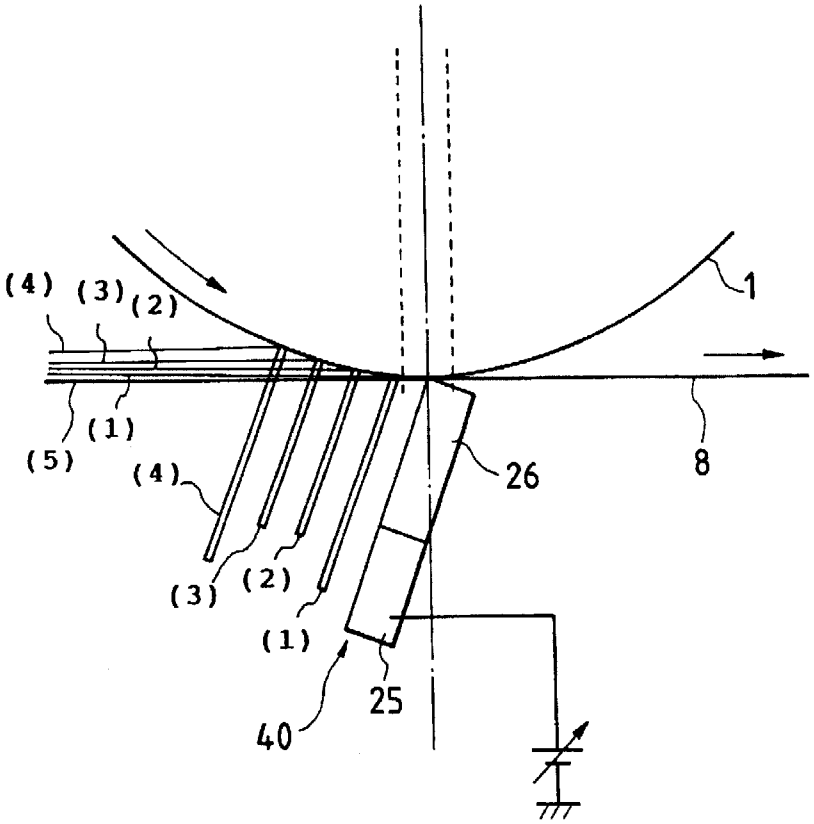
FIG. 12 is an explanatory view showing a test result regarding effects due to difference in portions of upstream urging-up members disposed in the vicinity of the transfer portion shown in FIG. 11.

In the present invention, tests for checking the ability for preventing the poor image and the pre-transfer discharge on the basis of the difference in set positions of the upstream urging-up member 200 were conducted. The upstream urging-up member 200 was formed from polyethylene terephthalate film having a thickness of 500 μm, and the set positions of the upstream urging-up member were changed to (1)–(4) as shown in FIG. 12. A position (1) is spaced apart from the transfer nip of the conductive blade 26 in the upstream direction thereof by about 3 mm. Positions (2), (3) and (4) are spaced apart from the position (5) in the upstream direction by about 3 mm, 6 mm and 9 mm, respectively. Accordingly, the position (4) is spaced apart from the transfer nip of the conductive blade 26 in the upstream direction thereof by about 12 mm.

The upstream urging-up member 200 was arranged at these positions successively and the transfer belt 8 was urged against the photosensitive drum 1 by the respective upstream urging-up member 200. The urged conditions of the transfer belt 8 associated with the positions (1)–(4) are also designated by (1)–(4). In FIG. 12, the symbol (5) designates a condition of a transfer belt in a comparison example in which an upstream urging-up member is not provided and a conductive blade is urged against a photosensitive drum with the interposition of a transfer belt.

The tests were effected by transferring half-tone images on plain sheets (recording materials) while changing the voltage applied to the conductive blade 26. And, the current values when the poor images were caused due to the pre-transfer discharge were compared with respect to the above positions. The test result is shown in the following Table 1:

TABLE 1

| urging-up member position | (5) None | (1) 3 mm upstream | (2) 6 mm upstream | (3) 9 mm upstream | (4) 12 mm upstream |
|---|---|---|---|---|---|
| poor image generation current (μA) | 18 | 22 | 24 | 26 | 34 |
| toner image scattering | much | much | less | less | none |

As shown in the Table 1, in comparison with the case (5) where the upstream urging-up member 200 is not provided, when the upstream urging-up member 200 is located at the position (1), since the gap between the photosensitive drum 1 and the transfer belt 8 can be diminished at the upstream side and in the vicinity of the conductive blade 26, the current value is relatively small. That is to say, so long as the value of voltage applied to the conductive blade is small, it was found that the pre-transfer discharge can be prevented. However, when the upstream urging-up member 200 is located at the position (1), since an area where there is no gap is small, it was found that, when the large current or large voltage is applied to the conductive blade, the electric field generated by the conductive blade is widened, thereby causing the pre-transfer discharge which results in the poor image.

When the upstream urging-up member 200 is located at the position (4), it was found that, even when the large current or large voltage is applied to the conductive blade 6 (for example, when the thick recording material is used or when an OHP is used as the recording material or when the image is formed on the second surface of the recording material), the pre-transfer discharge can be prevented.

Further, since the position (4) of the upstream urging-up member is determined in consideration of an error of several μA with respect to the actually used maximum current value of 25 μA and of an error of several mm based on the positional change due to the wear of the blade and/or the attachment error, when the upstream urging-up member is at the position (4), the toner image on the photosensitive drum could be transferred effectively, regardless of the change in environmental conditions and/or endurance. Further, it was found that the level of the toner scattering is proportional to the current value when the poor image was generated due to the pre-transfer discharge in the above tests.

Figure 13:
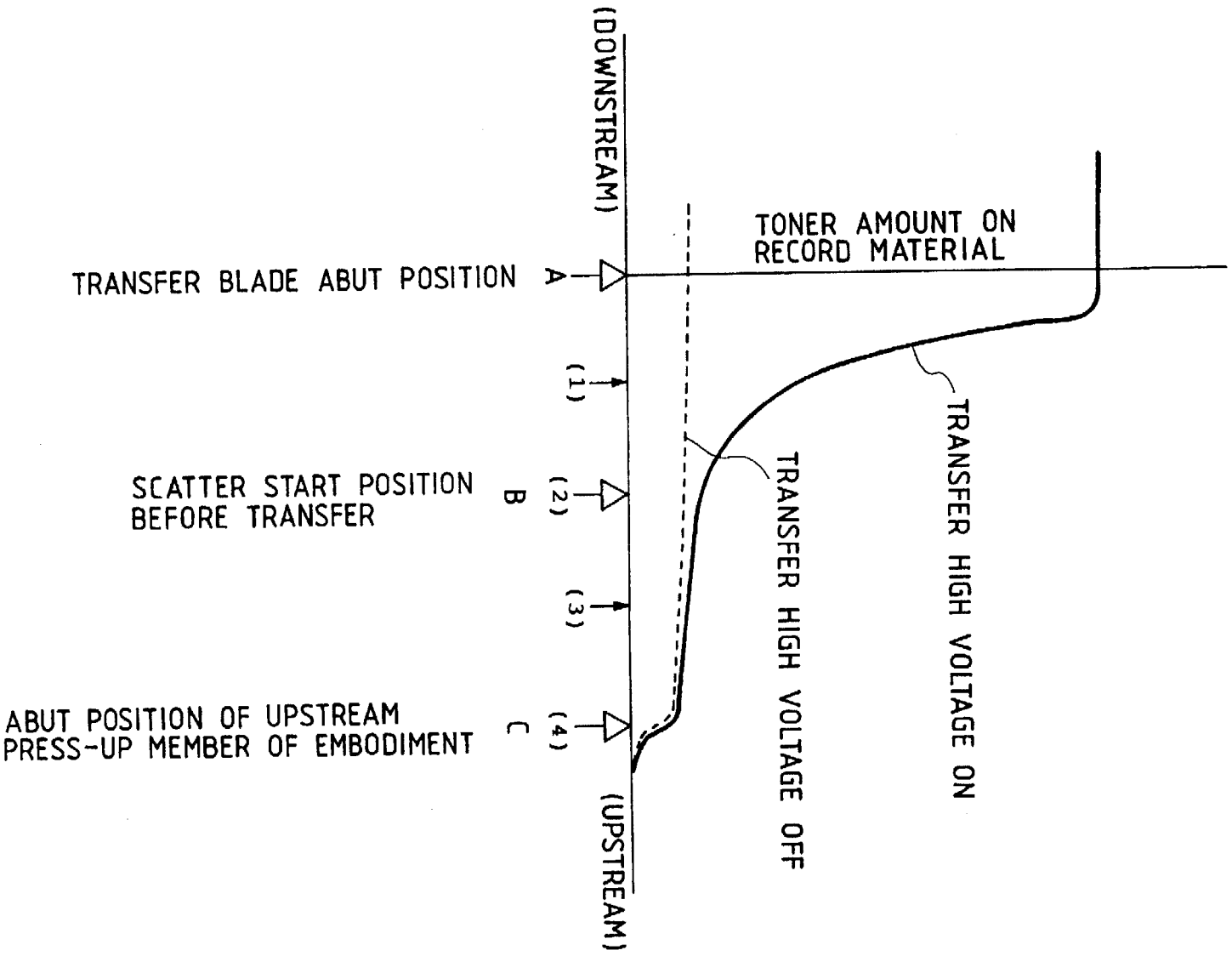
FIG. 13 is a graph showing a relation between transfer portions and toner amounts transferred to a recording material.

Next, the verification tests conducted regarding this embodiment will be explained. In image forming apparatuses in which the upstream urging-up members 200 are located at the positioned defined in this embodiment, all face half tone images were formed, and, during the transferring of the half tone images onto the recording material, power switches of the apparatuses were turned OFF, thereby forcibly stopping the transferring operations. In this case, a relation between the transferring process position and an amount of toner transferred onto the recording material is shown in FIG. 13. Incidentally, the transfer belt was formed from polyethylene terephthalate film having resistance of $10^{15}$ Ω.cm or more.

In FIG. 13, the solid line indicates the normal transferring process in which the high voltage is applied to the transfer charge member 40, and the broken line indicates the case where the normal transferring process is effected without application of high voltage. As can be seen from the broken line, a portion of the toner on the photosensitive drum 1 was transferred onto the recording material only by the potential difference between the photosensitive drum 1 and the recording material on the transfer belt 8 and the mechanical pressure due to the close contact between the photosensitive drum 1 and the recording material. Accordingly, it is considered that a portion of the solid line between the position B and the position C indicates the toner amount transferred in substantially the same condition as the broken line. Further, between the position B and the position A, under the action of the electric field generated by the voltage applied to the transfer charge member, the toner was transferred at the abrupt rising rate.

Considering the results of the poor image generation current and the toner scattering by overlapping the positions (1)–(4) of the upstream urging-up member 200 with the graph of FIG. 13, the pre-transfer toner scattering was started in the vicinity of the position (2), and the peak of the abnormal discharge reached in the vicinity of the position (1). Accordingly, in the illustrated embodiment, it is desirable that the transfer belt 8 is closely contacted with the photosensitive drum 1 by the upstream urging-up member 200 at the upstream side of the position B from where the pre-transfer scattering is started. Preferably, the transfer belt is closely contacted with the photosensitive drum at the position C (position (4)) where the solid line coincides with the broken line.

In the above example, while an example that the upstream urging-up member 200 is contacted with the photosensitive drum 1 via the deformed transfer belt 8 was explained, it is not necessary that the upstream urging-up member 200 is contacted with the photosensitive drum. That is to say, the upstream urging-up member 200 may be disposed out of the end of the area (at the upstream side of the transfer nip) which is influenced by the transfer electric field, so that the transfer belt 8 is contacted with the photosensitive drum 1 up to the area (at the upstream side of the transfer nip) which is influenced by the transfer electric field, but the upstream urging-up member 200 itself is not contacted with the photosensitive drum 1, thereby positively supporting the transfer belt 8 to prevent the up-and-down vibration of the belt due to the rotation of the transfer belt 8.

[Embodiment 9]

Figure 14:
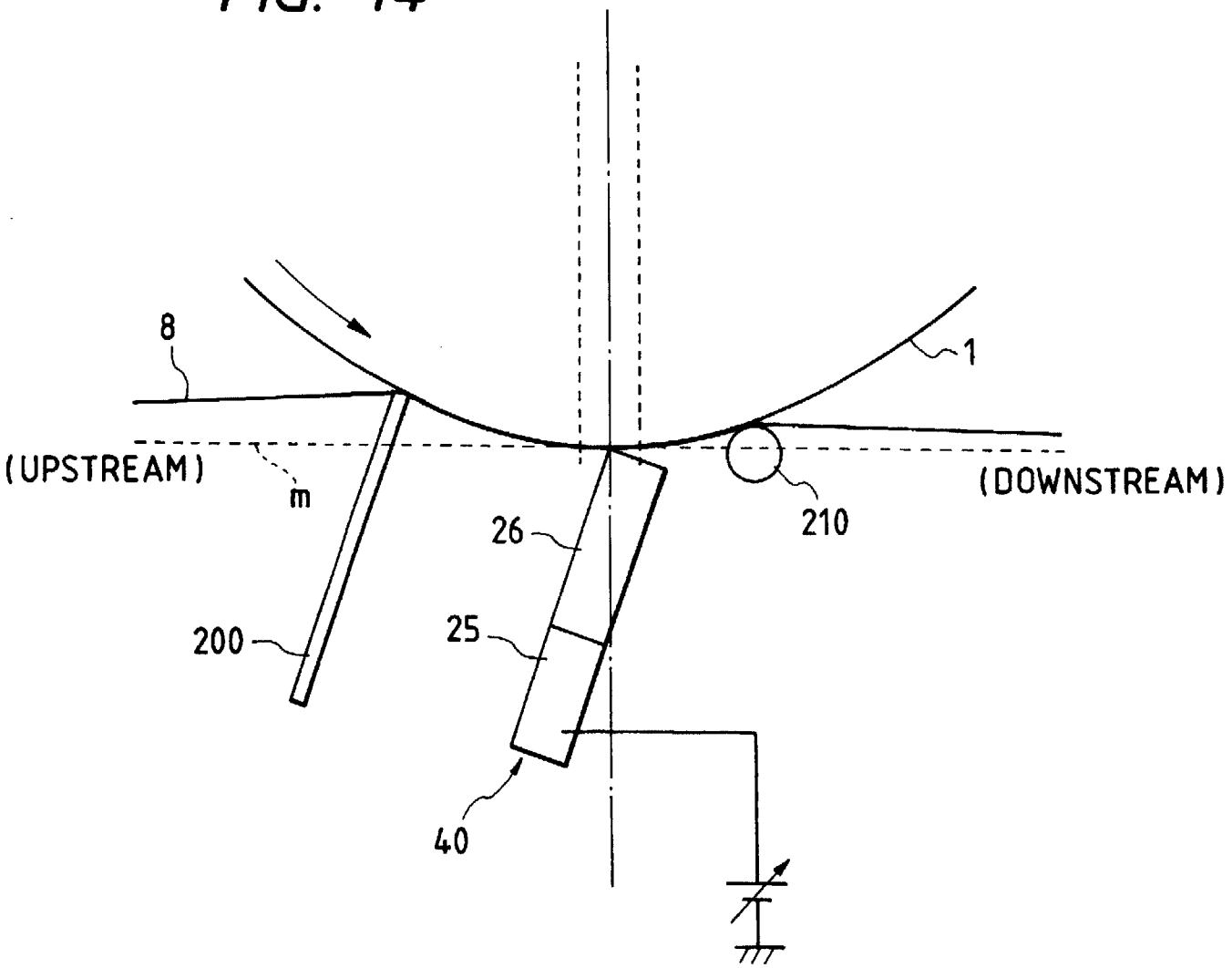
FIG. 14 is a sectional view showing an example of a transfer portion.
Figure 17:
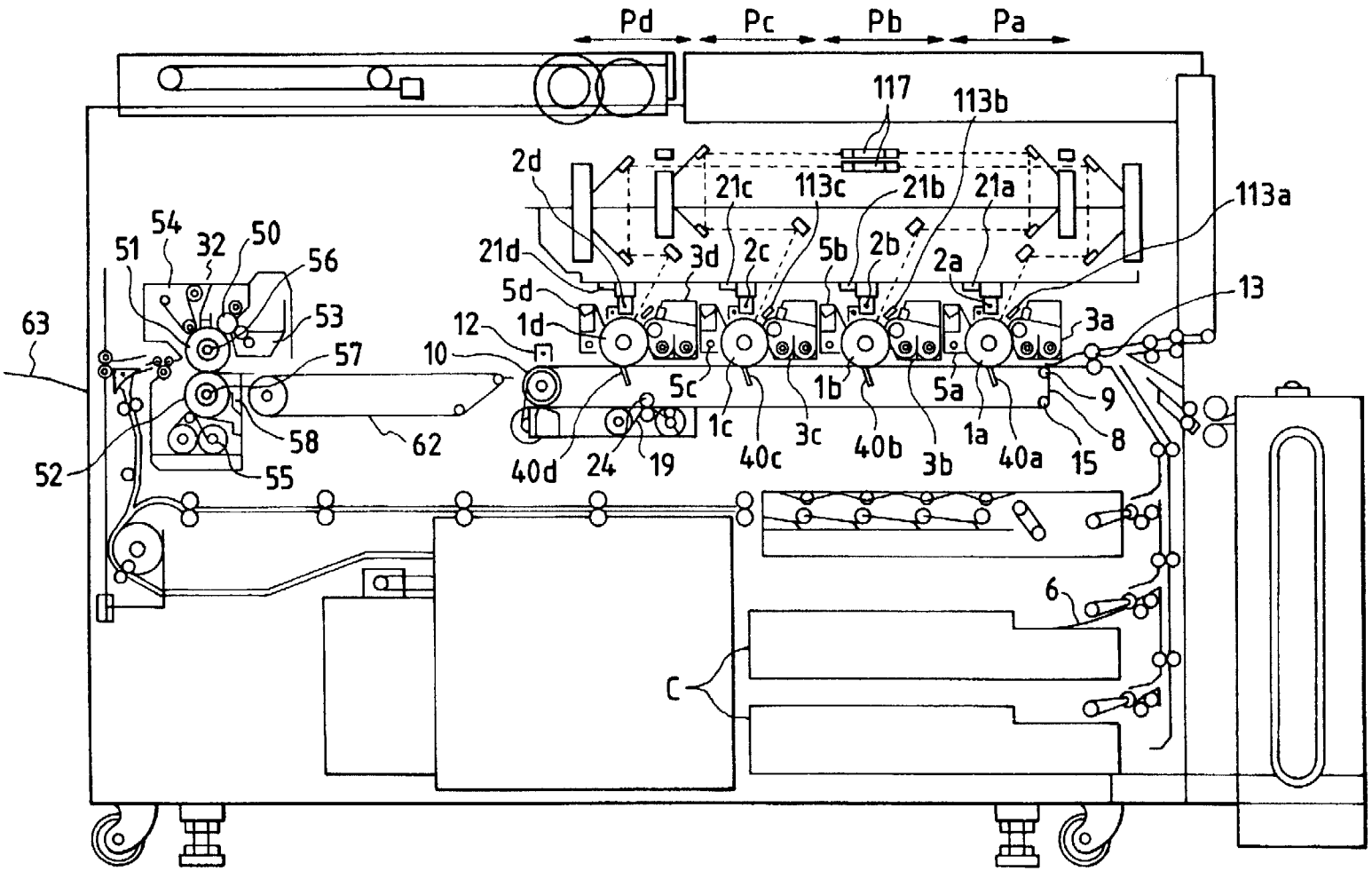
FIG. 17 is an elevational sectional view showing an example of an image forming apparatus.

A further example which can be applied to a transfer portion of the apparatus shown in FIG. 17 is shown in FIG. 14. In this embodiment, as shown in FIG. 14, in addition to the upstream urging-up member 200, an urging-up member 210 is disposed at a downstream side of the conductive blade 26. In FIG. 14, the same elements as those shown in FIG. 11 are designated by the same reference numerals.

As mentioned above, in the conventional apparatuses, it is obliged that the transferring operations are repeated in the condition that the discharge due to the peeling of toner from the photosensitive drum cannot be controlled. As a result, during the next transferring operation, due to the residual charge generated in the toner image on the recording material, the toner is re-transferred onto the photosensitive drum, thereby deteriorating the image. In this embodiment, in order to avoid such inconvenience, a downstream urging-up member 210 is provided.

In case where the downstream urging-up member 210 is provided, since the electric field area of the conductive blade 26 is shifted toward an upstream side, when the tests for checking the effect due to the difference in positions of the upstream urging-up member 200 as shown in the embodiment 8 were conducted, it was found that the value of the poor image generation current (due to the pre-transfer discharge) is decreased by about 4 μA. That is to say, by providing the downstream urging-up member 210, the current value of 22 μA at the position (1) is decreased to about 18 μA.

Accordingly, although it is preferable that the set position (4) of the upstream urging-up member 200 in the embodiment 8 is altered in consideration of the reduction of the poor image generation current value due to the provision of the downstream urging-up member 210, even when the poor image generation current value at the position (4) is decreased from 34 μA to about 30 μA, since the maximum value of the actually used current is 25 μA, there is no problem.

[Embodiment 10]

Figure 15:
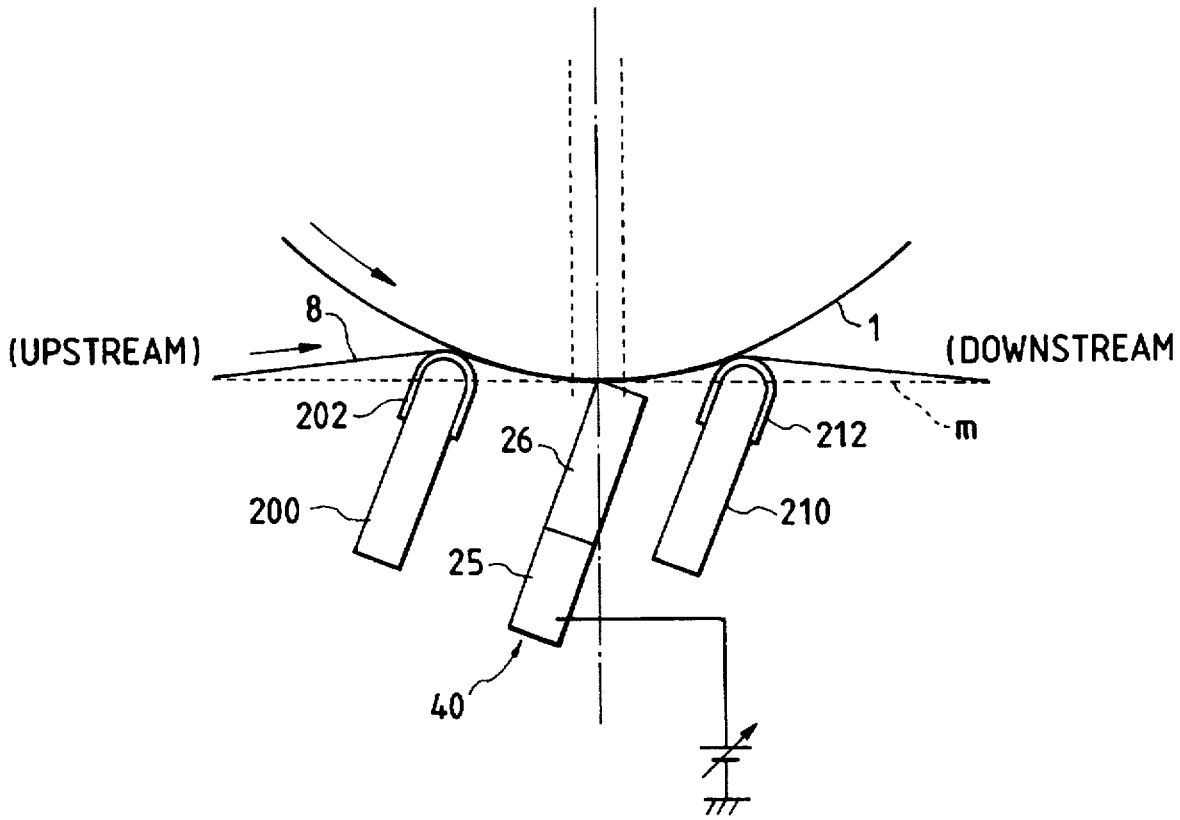
FIG. 15 is a sectional view showing an example of a transfer portion.

A still further example of a transfer portion which can be applied to the apparatus shown in FIG. 17 is shown in FIG. 15. As shown in FIG. 15, in this embodiment 10, upstream and downstream urging-up member bodies 200, 210 are covered by anti-wear layers 202, 212 arranged around contact portions between the transfer belt 8 and the urging-up member bodies.

In the illustrated embodiment, the upstream and downstream urging-up member bodies 200, 210 are made of ABS resin, and the anti-wear layers 202, 212 made of Teflon (trade mark) are coated thereon. Other than Teflon, the material of the anti-wear layers 202, 212 may be high-molecular compound such as Nylon or high density polyethylene which can reduce coefficient of friction between the anti-wear layer and the transfer belt 8. That is to say, each anti-wear layer have hardness greater than that of each urging-up member body and coefficient of friction smaller than that of each urging-up member body.

According to this embodiment, the defect caused by high coefficient of friction between the upstream urging-up member 200 or the downstream urging-up member 210 and the transfer belt 8 (i.e., wear of the upstream and downstream urging-up members 200, 210) can be avoided by the anti-wear layers 202, 212, and the vibration of the transfer belt 8 can be prevented. Accordingly, the occurrence of the poor image due to the pre-transfer discharge or the peel discharge can be prevented for a long time.

Figure 16:
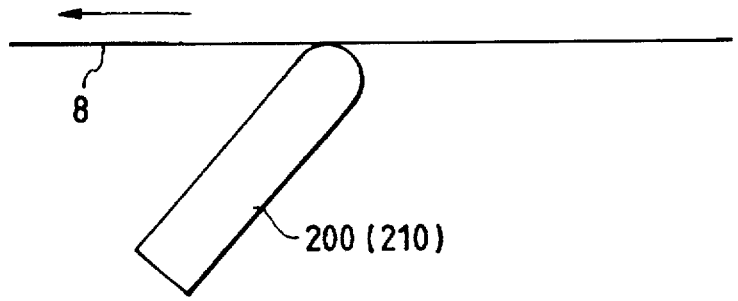
FIG. 16 is a sectional view showing another upstream and downstream urging-up member(s)

In the embodiments 8 to 10, while an example that the upstream and downstream urging-up members 200, 210 are inclined from the upstream side to the downstream side toward the transfer belt 8 to be urged against the transfer belt was explained, the present invention is not limited to such an example. For example, as shown in FIG. 16, the upstream and downstream urging-up members 200, 210 each formed from a plate member having a thickness along the shifting direction of the transfer belt 8. And, each urging-up member 200 (210) has a round end which is urged against the transfer belt 8 to form a transfer nip therebetween. In this case, when each urging-up member 200 (210) is inclined from a downstream side to an upstream side toward the transfer belt 8 or even when each urging-up member 200 (210) extends toward the transfer belt in perpendicular thereto, the wear of the abut end of the urging-up member can be prevented effectively.

Further, when the upstream and downstream urging-up members 200, 210 shown in FIG. 16 are covered by the anti-wear layers 202, 212 shown in FIG. 15, the anti-wear effect can be further improved.

It is preferable that the pressure of the upstream urging-up member 200 in the embodiments 8 to 10 against the belt 8 is smaller than the pressure of the transfer charge member against the belt 8. Further, a thickness of the transfer charge member is 500 μm to 50 mm, and, preferably, 1.0 mm to 2 mm. The total pressure of the transfer charge member against the belt is preferably 100 to 1200 grams. Hardness of the blade 26 is 20° to 80° (JIS A), and, preferably, 40° to 60° (JIS A).

A distance between the position where the transfer charge member is urged against the belt 8 and the position where the upstream urging-up member 200 is urged against the belt 8 is preferably 5 mm to 30 mm. The position where the upstream urging-up member 200 is urged against the belt 8 is protruded above the dot line m by 0.5 mm to 5 mm, and, preferably, 1 mm to 1.5 mm.

The present invention is not limited to the above-mentioned embodiments, but, various alterations and modifications can be effected within the scope of the present invention.

What is claimed is:

1. An image forming apparatus comprising:

an image bearing member;

a recording material bearing member for bearing and conveying a recording material to a transfer portion;

a transfer charge member for transferring an image from said image bearing member to the recording material born by said recording material bearing member, said transfer charge member being contacted with a rear surface of said recording material bearing member opposite to a front surface on which the recording material is born at said transfer portion; and an urging means for urging said rear surface of said recording material bearing member in the vicinity of said transfer portion;

wherein when a tangential line tangent to said image bearing member is drawn at a position where said transfer charge member is urged against said image bearing member via said recording material bearing member, said image bearing member and a position where said recording material bearing member is urged by said urging means are situated on the same side with respect to said tangential line.

2. An image forming apparatus according to claim 1, wherein said urging means includes a downstream urging member disposed downstream of said transfer portion in a shifting direction of said recording material bearing member.

3. An image forming apparatus according to claim 2, further comprising an electricity removal member adapted for removing electricity from said recording material bearing member and disposed in the vicinity of said downstream urging member and downstream of said downstream urging member in the shifting direction of said recording material bearing member.

4. An image forming apparatus according to claim 1 or 2, wherein said urging means further includes an upstream urging member disposed upstream of said transfer portion in the shifting direction of said recording material bearing member.

5. An image forming apparatus according to claim 2, wherein said downstream urging member is formed from a sheet member.

6. An image forming apparatus according to claim 4, wherein said upstream urging member is formed from a sheet member.

7. An image forming apparatus according to claim 1, wherein said transfer charge member is formed from a blade member.

8. An image forming apparatus according to claim 7, wherein an upstream angle between said transfer charge member and said recording material bearing member is an acute angle.

9. An image forming apparatus according to claim 1, wherein said transfer charge member and said urging means can be shifted away from said recording material bearing member.

10. An image forming apparatus according to claim 1, wherein, when the recording material is passed through said transfer portion, a deforming amount of said urging means becomes greater than a deforming amount of said transfer charge member.

11. An image forming apparatus according to claim 4, wherein a distance between a position where said transfer charge member is contacted with said recording material bearing member and a position where said recording material bearing member is urged by said urging means is 5 mm to 30 mm.

12. An image forming apparatus according to claim 4, wherein a distance between said tangential line and a position where said recording material bearing member is urged by said urging means is 0.5 mm to 5 mm.

13. An image forming apparatus according to claim 4, wherein said upstream urging member is disposed so that said recording material bearing member is contacted with said image bearing member at a most upstream side of an area where a transfer electric field is generated by said transfer charge member in the shifting direction of said recording material bearing member.

14. An image forming apparatus according to claim 6, wherein an upstream angle between said upstream urging member and said recording material bearing member is an acute angle.

15. An image forming apparatus according to claim 2, wherein said downstream urging member is disposed so that said recording material bearing member is contacted with said image bearing member at a most downstream side of an area where a transfer electric field is generated by said transfer charge member in the shifting direction of said recording material bearing member.

16. An image forming apparatus according to claim 1, wherein a plural color toner images are superimposedly transferred onto the recording material born by said recording material bearing member.

17. An image forming apparatus according to claim 1, wherein a plurality of said image bearing members and a plurality of said transfer charge members are provided, and a plurality of images are superimposedly transferred from said plurality of image bearing members onto the recording material born by said recording material bearing member.

18. An image forming apparatus according to claim 17, wherein a line connecting between the transfer portions of said plurality of image bearing members becomes a straight line.

19. An image forming apparatus comprising:

an image bearing member;

a recording material bearing member for bearing and conveying a recording material to a transfer portion, said recording material bearing member being a belt supported by a plurality of rollers;

a transfer charge member for transferring an image from said image bearing member to the recording material held by said recording material bearing member, said transfer charge member being contacted with a rear surface of said recording material bearing member opposite to a front surface on which the recording material is born at said transfer portion; and an upstream urging member disposed in the vicinity of said transfer portion and upstream of said transfer portion in a shifting direction of said recording material bearing member and adapted to urge said rear surface of said recording material bearing member;

wherein a position where said recording material bearing member is urged by said upstream urging member is protruded above a line connecting between a position where said image bearing member is urged by said transfer charge member via said recording material bearing member and a support finish position where the support of said recording material bearing member by said roller is finished upstream of said transfer portion in the shifting direction of said recording material bearing member.

20. An image forming apparatus according to claim 19, wherein said upstream urging member is formed from a sheet member.

21. An image forming apparatus according to claim 19, wherein said transfer charge member is formed from a blade member.

22. An image forming apparatus according to claim 21, wherein an upstream angle between said transfer charge member and said recording material bearing member is an acute angle.

23. An image forming apparatus according to claim 19, wherein said transfer charge member and said upstream urging member can be shifted away from said recording material bearing member.

24. An image forming apparatus according to claim 19, wherein, when the recording material is passed through said transfer portion, a deforming amount of said upstream urging member is greater than a deforming amount of said transfer charge member.

25. An image forming apparatus according to claim 19, wherein a distance between a position where said transfer charge member is contacted with said recording material bearing member and a position where said recording material bearing member is urged by said upstream urging member is 5 mm to 30 mm.

26. An image forming apparatus according to claim 19, wherein a distance between said line and a position where said recording material bearing member is urged by said upstream urging member is 0.5 mm to 5 mm.

27. An image forming apparatus according to claim 19, wherein said upstream urging member is disposed so that said recording material bearing member is contacted with said image bearing member at a most upstream side of an area where a transfer electric field is generated by said transfer charge member in the shifting direction of said recording material bearing member.

28. An image forming apparatus according to claim 20, wherein an upstream angle between said upstream urging member and said recording material bearing member is an acute angle.

29. An image forming apparatus according to claim 19, further comprising a downstream urging member disposed in the vicinity of said transfer portion and downstream of said transfer portion in a shifting direction of said recording material bearing member for urging said rear surface of said recording material bearing member.

30. An image forming apparatus according to claim 29, further comprising an electricity removal member for removing electricity from said recording material bearing member and disposed in the vicinity of said downstream urging member and downstream of said downstream urging member in the shifting direction of said recording material bearing member.

31. An image forming apparatus according to claim 29, wherein said downstream urging member is formed from a sheet member.

32. An image forming apparatus according to claim 29, wherein said downstream urging member is disposed so that said recording material bearing member is contacted with said image bearing member at a most downstream side of an area where a transfer electric field is generated by said transfer charge member in the shifting direction of said recording material bearing member.

33. An image forming apparatus according to claim 19, wherein a plural color toner images are superimposedly transferred onto the recording material born by said recording material bearing member.

34. An image forming apparatus according to claim 19, wherein a plurality of said image bearing members and a plurality of said transfer charge members are provided, and a plurality of images are superimposedly transferred from said plurality of image bearing members onto the recording material born by said recording material bearing member.

35. An image forming apparatus according to claim 34, wherein a line connecting between the transfer portions of said plurality of image bearing members is a straight line.

36. An image forming apparatus comprising:

an image bearing member;

a recording material bearing member for bearing and conveying a recording material to a transfer portion, said recording material bearing member being a belt supported by a plurality of rollers;

a transfer charge member for transferring an image from said image bearing member to the recording material born by said recording material bearing member, said transfer charge member being contacted with a rear surface of said recording material bearing member opposite to a front surface on which the recording material is born at said transfer portion; and a downstream urging member disposed in the vicinity of said transfer portion and downstream of said transfer portion in a shifting direction of said recording material bearing member for urging said rear surface of said recording material bearing member;

wherein a position where said recording material bearing member is urged by said downstream urging member is protruded above a line connecting between a position where said image bearing member is urged by said transfer charge member via said recording material bearing member and a support start position where the support of said recording material bearing member by said roller is started downstream of said transfer portion in the shifting direction of said recording material bearing member.

37. An image forming apparatus according to claim 36, further comprising an electricity removal member for removing electricity from said recording material bearing member and disposed in the vicinity of said downstream urging member and downstream of said downstream urging member in the shifting direction of said recording material bearing member.

38. An image forming apparatus according to claim 36, wherein said downstream urging member is formed from a sheet member.

39. An image forming apparatus according to claim 36, wherein said transfer charge member is formed from a blade member.

40. An image forming apparatus according to claim 39, wherein an upstream angle between said transfer charge member and said recording material bearing member is an acute angle.

41. An image forming apparatus according to claim 36, wherein a distance between a position where said transfer charge member is contacted with said recording material bearing member and a position where said recording material bearing member is urged by said downstream urging member is 5 mm to 30 mm.

42. An image forming apparatus according to claim 36, wherein a distance between said tangential line and a position where said recording material bearing member is urged by said downstream urging member is 0.5 mm to 5 mm.

43. An image forming apparatus according to claim 36, wherein an upstream angle between said downstream urging member and said recording material bearing member is an acute angle.

44. An image forming apparatus according to claim 36, wherein said downstream urging member is disposed so that said recording material bearing member is contacted with said image bearing member at a most downstream side of an area where a transfer electric field is generated by said transfer charge member in the shifting direction of said recording material bearing member.

45. An image forming apparatus according to claim 36, wherein a plural color toner images are superimposedly transferred onto the recording material born by said recording material bearing member.

46. An image forming apparatus according to claim 36, wherein a plurality of said image bearing members and a plurality of said transfer charge members are provided, and a plurality of images are superimposedly transferred from said plurality of image bearing members onto the recording material born by said recording material bearing member.

47. An image forming apparatus according to claim 46, wherein a line connecting between the transfer portions of said plurality of image bearing members is a straight line.

* * * * *